US008827822B2

(12) United States Patent
Lee et al.

(10) Patent No.: US 8,827,822 B2
(45) Date of Patent: Sep. 9, 2014

(54) ROBOT FOR VIRTUAL REALITY EXPERIENCE THAT GENERATES VARIOUS 3D-WAVEFORMS OF THE NON-FIXED CURVED TRAJECTORY

(75) Inventors: Wan Pyo Lee, Daejeon (KR); Dong One Ha, Daejeon (KR); Seung Hwan Paek, Daejeon (KR)

(73) Assignee: Xenarts., Inc, Daejeon (KR)

( * ) Notice: Subject to any disclaimer, the term of this patent is extended or adjusted under 35 U.S.C. 154(b) by 231 days.

(21) Appl. No.: 13/637,121

(22) PCT Filed: Nov. 15, 2010

(86) PCT No.: PCT/KR2010/008054

§ 371 (c)(1),
(2), (4) Date: Sep. 25, 2012

(87) PCT Pub. No.: WO2011/122753

PCT Pub. Date: Oct. 6, 2011

(65) Prior Publication Data

US 2013/0025400 A1 Jan. 31, 2013

(30) Foreign Application Priority Data

Mar. 31, 2010 (KR) ..... 10-2010-0029071
Jun. 23, 2010 (KR) ..... 10-2010-0059521

(51) Int. Cl.

| | |
|---|---|
| ***A63G 31/16*** | (2006.01) |
| ***A63G 31/02*** | (2006.01) |
| *A63G 19/20* | (2006.01) |
| *A63B 69/04* | (2006.01) |
| *A61H 1/00* | (2006.01) |

(52) U.S. Cl.

CPC ..... *A63G 31/02* (2013.01); *A61H 2201/5005* (2013.01); *A63B 69/04* (2013.01); *A61H 2201/1666* (2013.01); *A61H 1/005* (2013.01); *A61H 2201/149* (2013.01)

USPC ..... 472/59; 472/97; 472/130; 434/55; 74/490.09

(58) Field of Classification Search

USPC ..... 472/57, 59, 95–9, 99; 463/6, 7; 434/29, 434/55, 247; 74/490.07, 490.09

See application file for complete search history.

(56) References Cited

U.S. PATENT DOCUMENTS

| | | | | |
|---|---|---|---|---|
| 5,445,045 | A * | 8/1995 | Nagai et al. | 74/490.09 |
| 5,761,960 | A | 6/1998 | Nagai et al. | |
| 6,808,458 | B1 * | 10/2004 | Jung | 472/97 |
| 7,541,707 | B2 * | 6/2009 | Hochhalter et al. | 310/80 |
| 7,850,627 | B2 * | 12/2010 | Woo et al. | 601/86 |
| 2007/0207900 | A1 | 9/2007 | Huang et al. | |
| 2008/0146424 | A1 | 6/2008 | Ho | |

FOREIGN PATENT DOCUMENTS

| | | | |
|---|---|---|---|
| JP | 2008099816 | A | 5/2008 |
| JP | 2008-212475 | A | 9/2008 |

* cited by examiner

*Primary Examiner* — Kien Nguyen
(74) *Attorney, Agent, or Firm* — Sherr & Jiang, PLLC

(57) ABSTRACT

A robot for virtual reality experience, in which a settling body for a user is moved in multidirectional according to operation states of first and second moving units and first and second crank motors. The settling body creates various moving directions according to the operation states of the first and second moving units and the first and second crank motors, and each magnitude of forces applied to each moving direction is changed, thereby forming the various waveforms.

11 Claims, 22 Drawing Sheets

ROBOT FOR VIRTUAL REALITY EXPERIENCE THAT GENERATES VARIOUS 3D-WAVEFORMS OF THE NON-FIXED CURVED TRAJECTORY

CROSS REFERENCE TO PRIOR APPLICATIONS

This application is a National Stage Patent Application of PCT International Patent Application No. PCT/KR2010/008054 (filed on Nov. 15, 2010) under 35 U.S.C. §371, which claims priority to Korean Patent Application Nos. 10-2010-0029071 (filed on Mar. 31, 2010) and 10-2010-0059521 (filed on Jun. 23, 2010), which are all hereby incorporated by reference in their entirety.

TECHNICAL FIELD

The present invention relates to a robot for virtual reality experience, in which a user can ride, and more particularly to a robot for virtual reality experience, in which a riding body for a user can be moved in multi-directional and various sizes of waveforms according to operation states of first and second moving units and first and second crank motors. The present invention relates to a robot for virtual reality experience that generates various 3D-waveforms of the non-fixed curved trajectory.

BACKGROUND ART

A movement of almost every object, such as a person, a horse, a board, a ski and a car, under gravitation is a series of waveforms with different lengths and amplitudes due to various changes in speed. In order to make a more realistic robot for virtual reality experience, in which a person can ride, it is basically necessary to independently control a speed, length and amplitude of the waveform and it is also required to form different types of waveforms by continuously controlling the speed, length and amplitude of the waveform in real time.

Conventional robots for virtual reality experience, which have been developed till now, mainly use a hydraulic cylinder. Almost of them can provide only directional characteristics, such as an ascent and a descent, using four or six axes. Thus, the conventional robots for virtual reality experience cannot provide the rhythms of changed waveforms. Further, there are some disadvantages in its high manufacturing cost and large size.

DISCLOSURE

Technical Problem

An object of the present invention is to provide a robot for virtual reality experience, which can continuously create various waveforms having different speed and amplitude in real time. The robot for virtual reality experience of the present invention is a very important core technology which forms the foundation of a virtual reality experience part of the virtual reality technology. The present invention can be combined with various contents and thus used in arcade game, medical treatment, education and almost all industrial fields. Therefore, another object of the present invention is to provide a robot for virtual reality experience, which can create high added value and also can be used in various fields.

Technical Solution

To achieve the object of the present invention, the present invention provides a robot for virtual reality experience that generates various 3D-waveforms of the non-fixed curved trajectory, comprising a settling body 1300 on which a user can ride; and one or more moving units U1, U2 which are disposed at a lower side of the settling body 1300 so as to move the settling body 1300 up/down or left/right, the moving unit units U1, U2 comprising a rotation supporting body 100, 150; a main rotating body 300, 350 which is installed at the rotation supporting body 100, 150 so as to be rotatable by external driving force and in which a main through-hole 341, 371 is formed in a length direction, and a first main installing protrusion 361, 391 and a second main installing protrusion 362, 392 protruded in a length direction are formed at one side thereof so as to be opposed to each other with the main through-hole 341, 371 in the center; a guide shaft 810, 850 of which one end is installed at the first main installing protrusion 361, 391 and the other end is installed at the second main installing protrusion 362, 392 and that a screw thread is formed on an outer circumferential surface thereof; a moving body 820, 870 which are coupled with the guide shaft 810, 850; and a control module M which rotates the guide shaft 810, 850 so that the moving body 820, 870 is moved in a length direction of the guide shaft 810, 850.

Preferably, the control module M comprises a first sub rotating body 410 which is axially formed with a first sub through-hole 411-1 and provided with a first sub rotating shaft 411 rotatably inserted into the main through-hole 341 and a first sub gear 412 formed at an outer circumferential surface of one end of the first sub rotating shaft 411 and located at an outer side of the main rotating body 300; a second sub rotating body 420 which is provided with a second sub rotating shaft 421 rotatably inserted into the first sub through-hole 411-1 and a second sub gear 422 formed at an outer circumferential surface of one end of the second sub rotating shaft 421 so as to be located at an outer side of the first sub gear 412; a first rotation stopper 510 which functions to stop rotation of the first sub rotating body 410 by external force; a second rotation stopper 520 which functions to stop rotation of the second sub rotating body 420 by external force; a 1-1st operation gear 611 which is rotatably installed at one end of the main rotating body 300 and engaged with the first sub gear 412; a 1-1st bevel gear 711 which is integrally formed at an outer surface of the 1-1st operation gear 611; a 1-2nd operation gear 612 which is rotatably installed at an inner surface of the first main installing protrusion 361; a 1-2nd bevel gear 712 which is integrally formed at an outer surface of the 1-2nd operation gear 612 and engaged with the 1-1st bevel gear 711; a 1-3rd operation gear 613 which is rotatably installed at an inner surface of the first main installing protrusion 361 and engaged with the 1-2nd operation gear 612; a 2-1st operation gear 621 which is rotatably installed at one end of the main rotating body 300 so as to be opposed to the 1-1st operation gear 611 and which is engaged with the second sub gear 422; a 2-1st bevel gear 721 which is integrally formed at an outer surface of the 2-1st operation gear 621; a 2-2nd operation gear 622 which is rotatably installed at an inner surface of the second main installing protrusion 362; a 2-2nd bevel gear 722 which is integrally formed at an outer surface of the 2-2nd operation gear 622 and engaged with the 2-1st bevel gear 721; and a 2-3rd operation gear 623 is rotatably installed at an inner surface of the second main installing protrusion 362 and engaged with the 2-2nd operation gear 622, and wherein one end of the guide shaft 810 is integrally connected to an outer surface of the 1-3rd operation gear 613 so as to be integrally rotated together with the 1-3rd operation gear 613 and the 2-3rd operation gear 623, and the other end thereof is integrally connected to an outer surface of the 2-3rd operation gear 623.

Preferably, the robot for virtual reality experience further comprises a first sub coupling plate 413 which is integrally coupled to the other end of the first sub rotating shaft 411 so as to be located at an outer side of the other end of the main rotating body 300 and which is formed with a through-hole for first sub coupling plate through which a second sub rotating shaft 421 is rotatably passed; a second sub coupling plate 423 which is integrally coupled to the other end of the second sub rotating shaft 421 so as to be located at an outer side of an outer side of the first sub coupling plate 413; and a stopping supporter 530 which is disposed between the first and second sub coupling plates 413 and 423 and through which the second sub rotating shaft 421 is rotatably passed, wherein the first rotation stopper 510 is a first rotation stopping plate which is attached to one surface of the stopping supporter 530 so as to be capable of being coupled to the first sub coupling plate 413 by electromagnetic force generated from an electromagnet installed therein, and the second rotation stopper 520 is a second rotation stopping plate which is attached to the other surface of the stopping supporter 530 so as to be capable of being coupled to the second sub coupling plate 423 by electromagnetic force generated from an electromagnet installed therein.

Preferably, the main rotating body 300 comprises a worm wheel 310 that a worm wheel inserting hole is formed in a center portion thereof; an insertion shaft 340 which is inserted into the worm wheel inserting hole and integrally coupled to the worm wheel 310 and which is formed with the main through-hole 341; and a rotating plate 360M which is integrally coupled to the outer circumferential surface of the one end of the insertion shaft 340 and on which the first and second main installing protrusion 361 and 362 are protruded, wherein a worm 210 which rotates the worm wheel by external driving force is installed at the rotation supporting body 100.

Preferably, the control module M comprises a sub rotating body 450 which is provide with a sub rotating shaft 460 rotatably inserted into the main through-hole 371, a sub gear 451 disposed at an outer circumferential surface of one end of the sub rotating shaft 460 and located at an outer side of the main rotating body 350, and a first control gear 452 formed at an outer surface of the other end of the sub rotating shaft 460 and located at an outer side of one end of the rotation supporting body 150; a second control gear 552 which is engaged with the first control gear 452; a control motor 550 which rotates the second control gear 552; an operation gear 650 which is rotatably installed at one end of the main rotating body 300 and engaged with the sub gear 451; a first bevel gear 750 which is integrally formed at an outer surface of the operation gear 650; and a second bevel gear 751 which is rotatably installed at an inner surface of one of the first and second main installing protrusions 391 and 392 and engaged with the first bevel gear 750, wherein one end of the guide shaft 850 is connected to the second bevel gear 751 so that the guide shaft 850 can be integrally rotated with the second bevel gear 751.

Preferably, the main rotating body 350 comprises a worm wheel 360; an insertion shaft 370 in which the worm wheel 360 is inserted; and a rotating plate 390M which is coupled to the outer circumferential surface of the one end of the insertion shaft 370 and on which the first main installing protrusion 391 and the second main installing protrusion 392 are protruded, and wherein a worm 250 which rotates the worm wheel 360 by external driving force is installed at the rotation supporting body 150.

Preferably, the robot for virtual reality experience further comprises a first crank 1100 comprising a first lower rod 1110 of which a lower end is connected to the first moving unit U1 of the robot for virtual reality experience so as to be moved left/right and up/down, a first crank connecting portion 1100C of which a lower end is connected to the first lower rod 1110 so that the first crank connecting portion 1100C can be rotated about a rotational center line thereof, which is passed through up and down, and a first upper rod 1120 of which a lower end is connected to the first crank connecting portion 1100C so that the first upper rod 1120 can be rotated about a rotational center line thereof, which is horizontally passed through; a second crank 1200 comprising a second lower rod 1210 of which a lower end is connected to the second moving unit U2 of the robot for virtual reality experience so as to be moved left/right and up/down, a second crank connecting portion 1200C of which a lower end is connected to the second lower rod 1210 so that the second crank connecting portion 1200C can be rotated about a rotational center line thereof, which is passed through up and down, and a second upper rod 1220 of which a lower end is connected to the second crank connecting portion 1200C so that the second upper rod 1220 can be rotated about a rotational center line thereof, which is horizontally passed through; a first linear guide 1130 which is installed at the first upper rod 1120 so as to guide a movement in a horizontal direction which is the same as the rotational center line of the first upper rod 1120; a first horizontally moving body 1140 which is installed at the first linear guide 1130 so as to be guided along the first linear guide 1130 by driving force of a first crank motor 1160; a second linear guide 1230 which is installed at the second upper rod 1220 so as to guide a movement in a horizontal direction which is the same as the rotational center line of the second upper rod 1220; and a second horizontally moving body 1240 which is installed at the second linear guide 1230 so as to be guided along the second linear guide 1230 by driving force of a second crank motor 1260, wherein a first moving body guiding rod 1310 to which the first horizontally moving body 1140 is connected so as to be slidable in a perpendicular direction to a guiding direction of the first linear guide 1130 is formed at one side of the settling body 1300, and the second horizontally moving body 1240 is fixedly connected to the other side of the settling body 1300.

Preferably, the robot for virtual reality experience further comprises a first crank motor mount 1150 of which one end is fixed to the first horizontally moving body 1140, and the other end thereof is fixed with the first crank motor 1160; a first rotating plate 1170 which is connected to the first crank motor 1160; a first rotating bar 1180 of which one end is rotatably connected to the first rotating plate 1170 and the other end is rotatably connected to the first upper rod 1120, such that the first horizontally moving body 1140 is guided along the first linear guide 1130 when the first crank motor 1160 is operated; a second crank motor mount 1250 of which one end is fixed to the second horizontally moving body 1240 and the other end is fixed to the second crank motor 1260; a second rotating plate 1270 which is rotatably connected to the second crank motor 1260; and a second rotating bar 1280 of which one end is rotatably connected to the second rotating plate 1270 and the other end is rotatably connected to the second upper rod 1220, such that the second horizontally moving body 1240 is guided along the second linear guide 1230 when the second crank motor 1260 is operated.

Preferably, the robot for virtual reality experience further comprises a first rotating plate protruded shaft 1172 which is formed on a first rotating plate 1170; a 1-1st bearing 1181 which is installed at one end of the first rotating bar 1180 so that the one end of the first rotating bar 1180 can be relatively rotated with respect to the first protruded shaft 1172 of the first rotating plate 1170; a first upper rod protruded shaft 1122 which is formed on the first upper rod 1120; a 1-2nd bearing 1182 which is installed at the other end of the first rotating bar 1180 so that the other end of the first rotating bar 1180 can be relatively rotated with respect to the first upper rod protruded shaft 1122; a second rotating plate protruded shaft 1272 which is formed on a second rotating plate 1270; a 2-1st bearing 1281 which is installed at one end of the second rotating bar 1280 so that the one end of the second rotating bar 1280 can be relatively rotated with respect to the second rotating plate protruded shaft 1272; a second upper rod protruded shaft 1222 which is formed on the second upper rod 1220; and a 2-2st bearing 1282 which is installed at the other end of the second rotating bar 1280 so that the other end of the second rotating bar 1280 can be relatively rotated with respect to the second upper rod protruded shaft 1222.

Preferably, the robot for virtual reality experience further comprises a first lower rod guiding body 1410 which is inserted onto the first lower rod 1110 so as to guide an up and down movement of the first lower rod 1110; a first left/right movement guiding rod 1510 which is inserted into the first lower rod guiding body 1410 so as to guide a left and right movement of the first lower rod guiding body 1410; a second lower rod guiding body 1420 which is inserted onto the second lower rod 1210 so as to guide an up and down movement of the second lower rod 1210; and a second left/right movement guiding rod 1520 which is inserted into the second lower rod guiding body 1420 so as to guide a left and right movement of the second lower rod guiding body 1420.

Preferably, the first crank connecting portion 1100C is supported by a first taper bearing 1100T mounted on the first lower rod 1110 and disposed to be rotatable about the rotational center line of the first crank connecting portion 1100C, and the second crank connecting portion 1200C is supported by a second taper bearing 1200T mounted on the second lower rod 1210 and disposed to be rotatable about the rotational center line of the second crank connecting portion 1200C.

Advantageous Effects

According to the present invention, the settling body can be moved up and down (in a z-axial direction), moved left and right (in a y-axial direction) or moved complexly according as the operation state of the first and second moving unit. The present invention can be moved front and back (in an x-axial direction) according to the operation state of the first and second crank motors, and thus the settling body can create movements having various waveforms which pass through planes formed by the first and second lower rods.

Accordingly, the settling body of the present invention can create various moving directions according to the operation states of the first and second moving units and the first and second crank motors, and each magnitude of forces applied to each moving direction can be changed, thereby forming the various waveforms. Therefore, the settling body can create the various 3D-waveforms of the non-fixed curved trajectory due to the independent or complex movements in the x, y and z-axial directions.

DESCRIPTION OF DRAWINGS

The above and other objects, features and advantages of the present invention will become apparent from the following description of preferred embodiments given in conjunction with the accompanying drawings, in which.

BEST MODE

Figure 1:
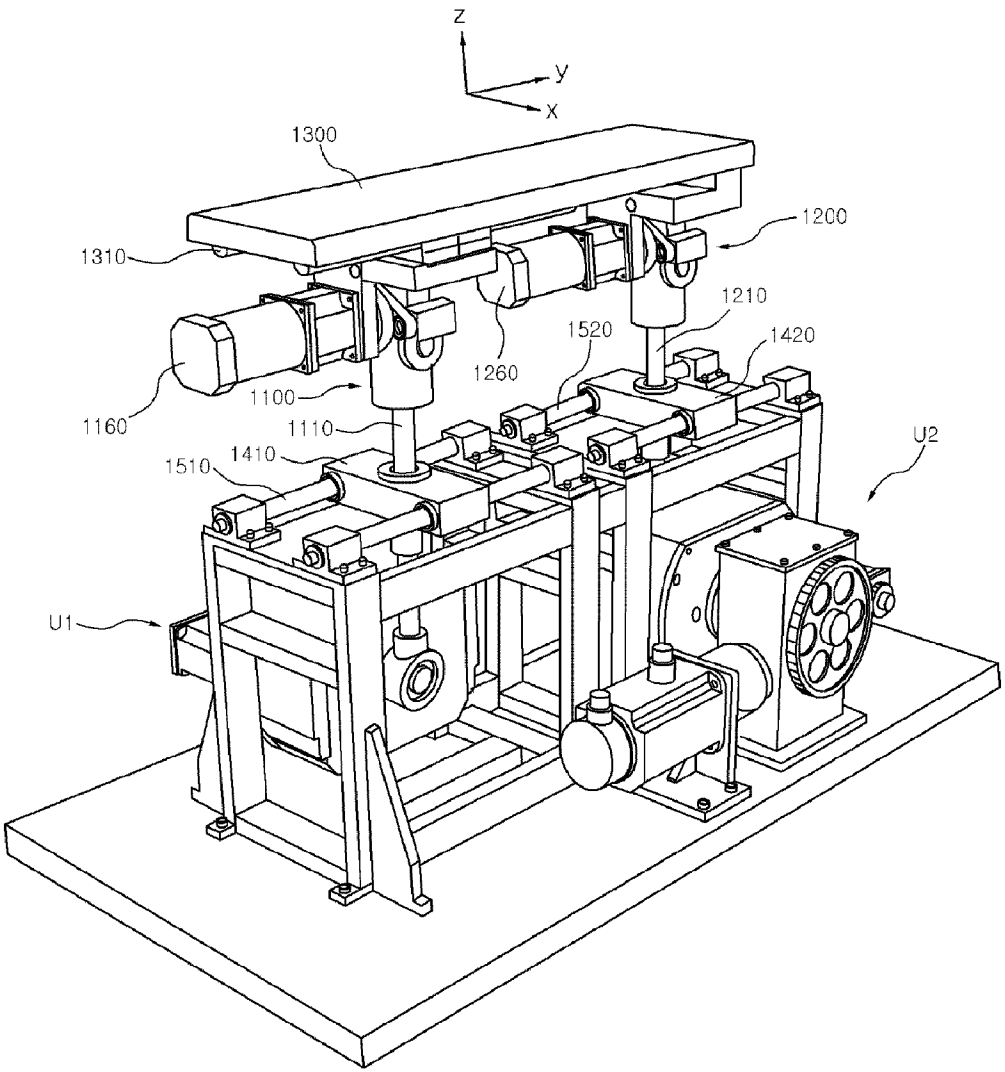
FIG. 1 is a perspective view of the present invention.

Referring to FIG. 1, the present invention includes first and second moving units U1 and U2, a crank device set which is disposed at upper sides of the first and second moving units U1 and U2, and the like. For convenience of understanding, the present invention will be described in the above-mentioned order.

Firstly, the first and second moving units U1 and U2 will be described.

First Embodiment of the First or Second Moving Unit

Figure 2:
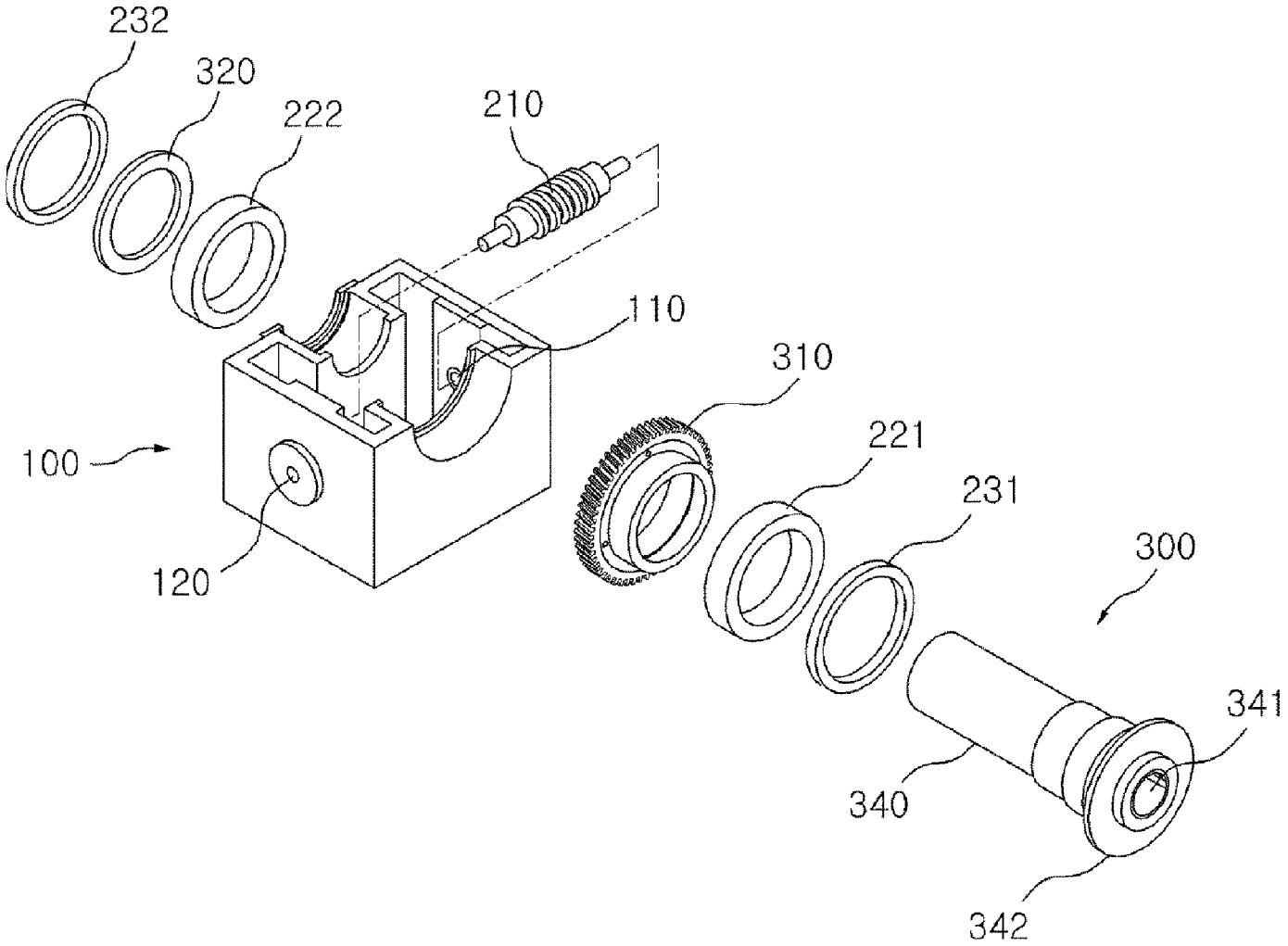
FIG. 2 is an exploded perspective view of a first or second moving unit of the present invention.

Referring to FIG. 2, the first and second moving units U1 and U2 of the present invention are provided with a rotation supporting body 100. A worm 210 which is rotatable by external driving force is installed in the rotation supporting body 100. In order to install the worm 210, a hole 110, 120 is formed at both sides of the rotation supporting body 100. Therefore, the driving force is transferred form an outside to the worm 210 by using a motor or the like, and thus the worm 210 can be smoothly rotated.

Figure 3:
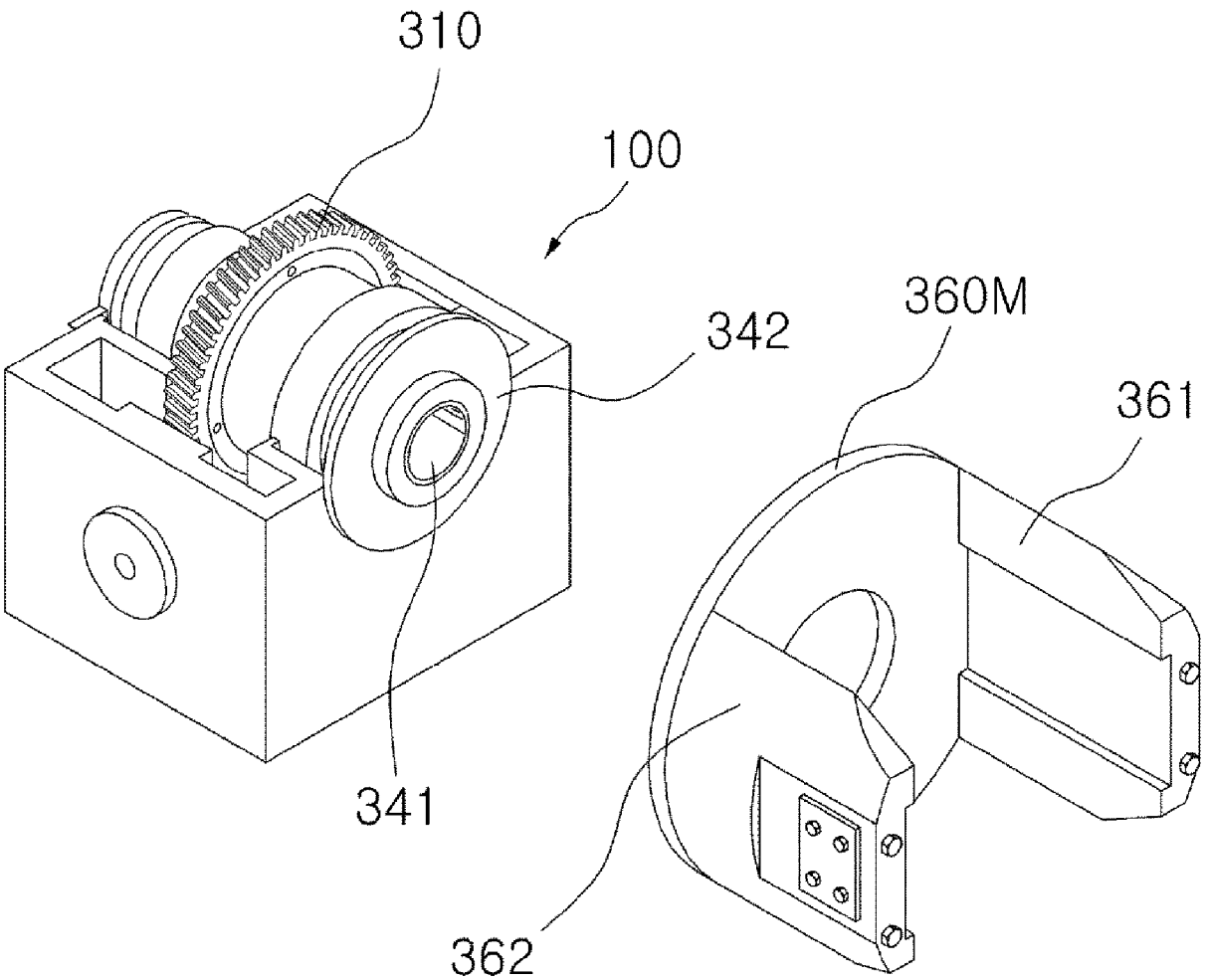
FIGS. 3 to 8 are perspective views of a main part of the first or second moving unit of the present invention.

Referring to FIGS. 2 and 3, a main rotating body 300 is rotatably installed at the rotation supporting body 100 so as to be interlocked with rotation of the worm 210. The main rotating body 300 includes a worm wheel 310 engaged with the worm 210, a lock nut 320, an insertion shaft 340, a rotating plate 360M, a first main installing protrusion 361 and a second main installing protrusion 362, and the like.

Referring to FIG. 2, a worm wheel inserting hole is formed in a center portion of the worm wheel 310. The insertion shaft 340 is inserted and fixed into the worm wheel inserting hole so as to be integrally rotated with the worm wheel 310. A stopping portion 342 is formed to be protruded on an outer circumferential surface of one end of the insertion shaft 340. Meanwhile, a main through-hole 341 is axially formed in a center portion of the insertion shaft 340.

Referring to FIG. 2, the insertion shaft 340 is supported by the rotation supporting body 100 and also supported to be rotatable by first and second bearings 221 and 222 which are disposed at both sides of the insertion shaft 340 with the worm wheel 310 in the center. Meanwhile, a first oil sealing member 231 is interposed between the first bearing 221 and the stopping portion 342, and the lock nut 320 is inserted at an outer side of the second bearing 222. The lock nut 320 is inserted onto an outer circumferential surface of the other end of the insertion shaft 340. Therefore, it is prevented by the lock nut 320 and the stopping portion 342 that the insertion shaft 340 is separated from the worm wheel 310. A second oil sealing member 232 is inserted at an outer side of the lock nut 320.

Referring to FIG. 3, a rotating plate 360M is coupled to the outer circumferential surface of the one end of the insertion shaft 340 so as to be integrally rotated with the insertion shaft 340. Meanwhile, the first main installing protrusion 361 and the second main installing protrusion 362 are formed on an outer surface of the rotating plate 360M so as to be protruded in a vertical direction to the rotating plate 360M. The first main installing protrusion 361 and the second main installing protrusion 362 are formed to be opposed to each other with the main through-hole 341 in the center.

Figure 4:
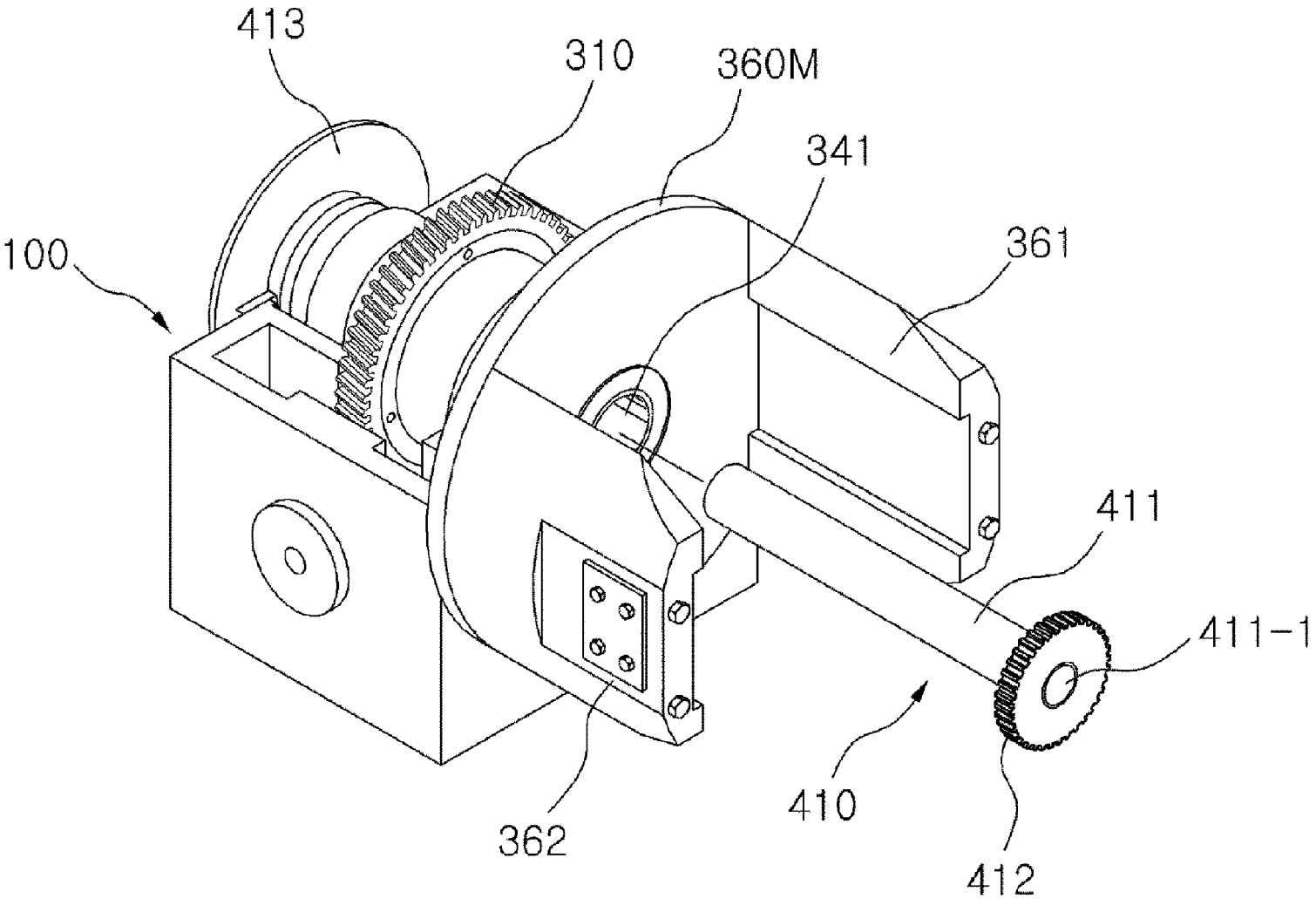
Figure 5:
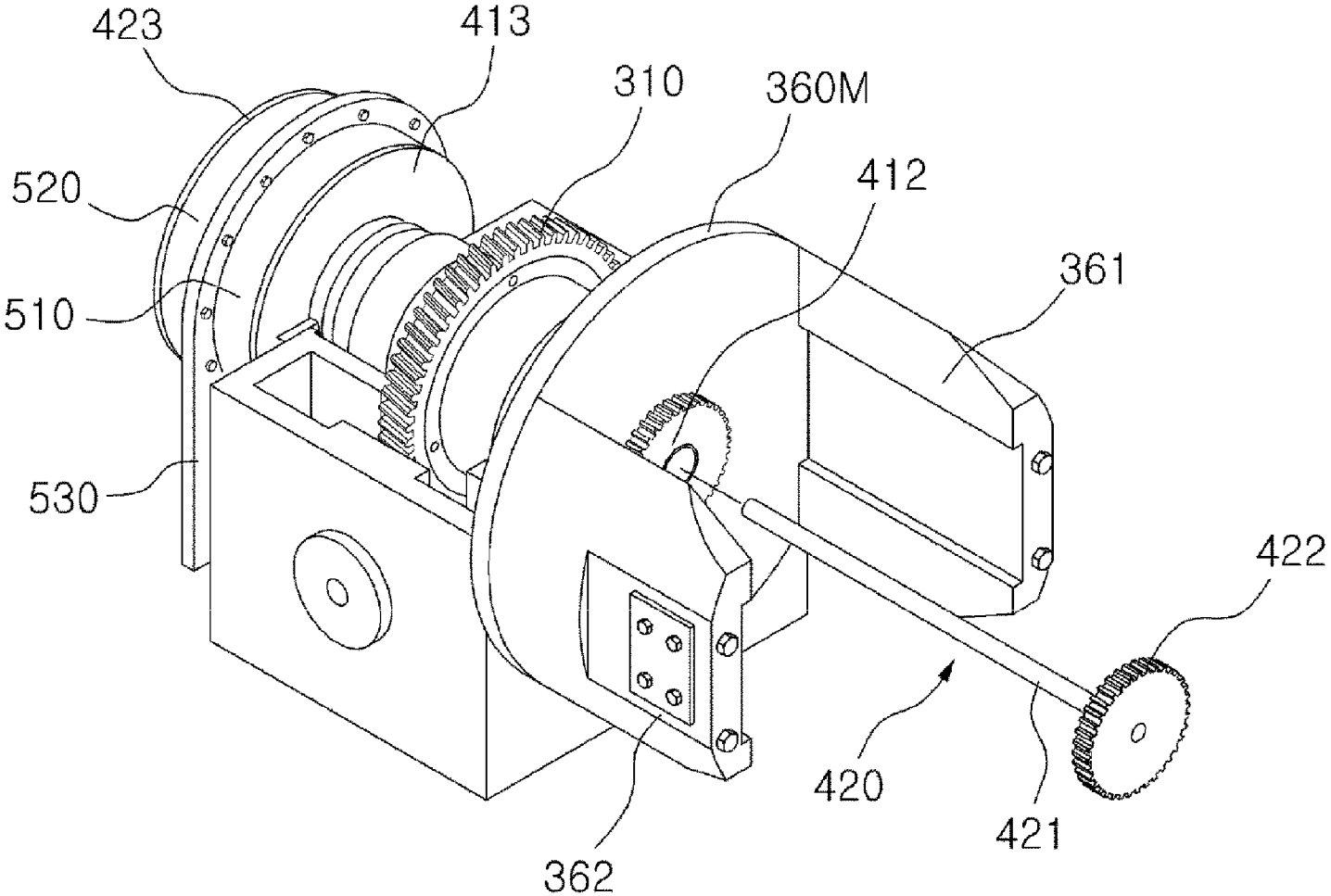

Referring to FIGS. 4 and 5, a first sub rotating body 410 is rotatably installed in the main rotating body 300. The first sub rotating body 410 includes a first sub rotating shaft 411 which is rotatably inserted into the main through-hole 341. A first sub through-hole 411-1 is axially formed in the first sub rotating shaft 411. Meanwhile, a first sub gear 412 is disposed at an outer circumferential surface of one end of the first sub rotating shaft 411.

The first sub gear 412 is located at an outer side of the rotating plate 360M. And a first coupling plate 413 is integrally coupled to the other end of the first sub rotating shaft 411. The first sub coupling plate 413 is located at an outer side of the other end of the main rotating body 300. Meanwhile, the first sub coupling plate 413 is formed with a through-hole for first sub coupling plate through which a second sub rotating shaft 421 is rotatably passed.

Referring to FIGS. 4 and 5, a second sub rotating body 420 is rotatably installed at the first sub rotating body 410. The second sub rotating body 420 includes a second sub rotating shaft 421 which is rotatably inserted into the first sub through-hole 411-1. Meanwhile, a second sub gear 422 is disposed at an outer circumferential surface of one end of the second sub rotating shaft 421. The second sub gear 422 is located at an outer side of the first sub gear 412. And a second sub coupling plate 423 is integrally coupled to the other end of the second sub rotating shaft 421. The second sub coupling plate 423 is located at an outer side of an outer side of the first sub coupling plate 413.

Referring to FIG. 5, a stopping supporter 530 through which the second sub rotating shaft 421 is rotatably passed is disposed between the first and second sub coupling plates 413 and 423.

Referring to FIG. 5, a first rotation stopper 510 which functions to stop rotation of the first sub rotating body 410 by external force is attached to one side surface of the stopping supporter 530, and a second rotation stopper 520 which functions to stop rotation of the second sub rotating body 420 by external force is attached to the other side surface of the stopping supporter 530.

Referring to FIG. 5, an electromagnet is disposed in the first rotation stopper 510 so as to generate magnetic force by a current supplied from an outside. When the current is applied, the first rotation stopper 510 attracts the first sub rotating body 410, which is provided with the first sub coupling plate 413, by electromagnetic force. Thus, the first sub coupling plate 413 is attached to one side of the first rotation stopper 510 so that the rotation of the first sub rotating body 410 is stopped.

Referring to FIG. 5, an electromagnet is disposed in the second rotation stopper 520 so as to generate magnetic force by a current supplied from an outside. When the current is applied, the second rotation stopper 520 attracts the second sub rotating body 420, which is provided with the second sub coupling plate 423, by electromagnetic force. Thus, the second sub coupling plate 423 is attached to one side of the second rotation stopper 520 so that the rotation of the second sub rotating body 420 is stopped.

Figure 6:
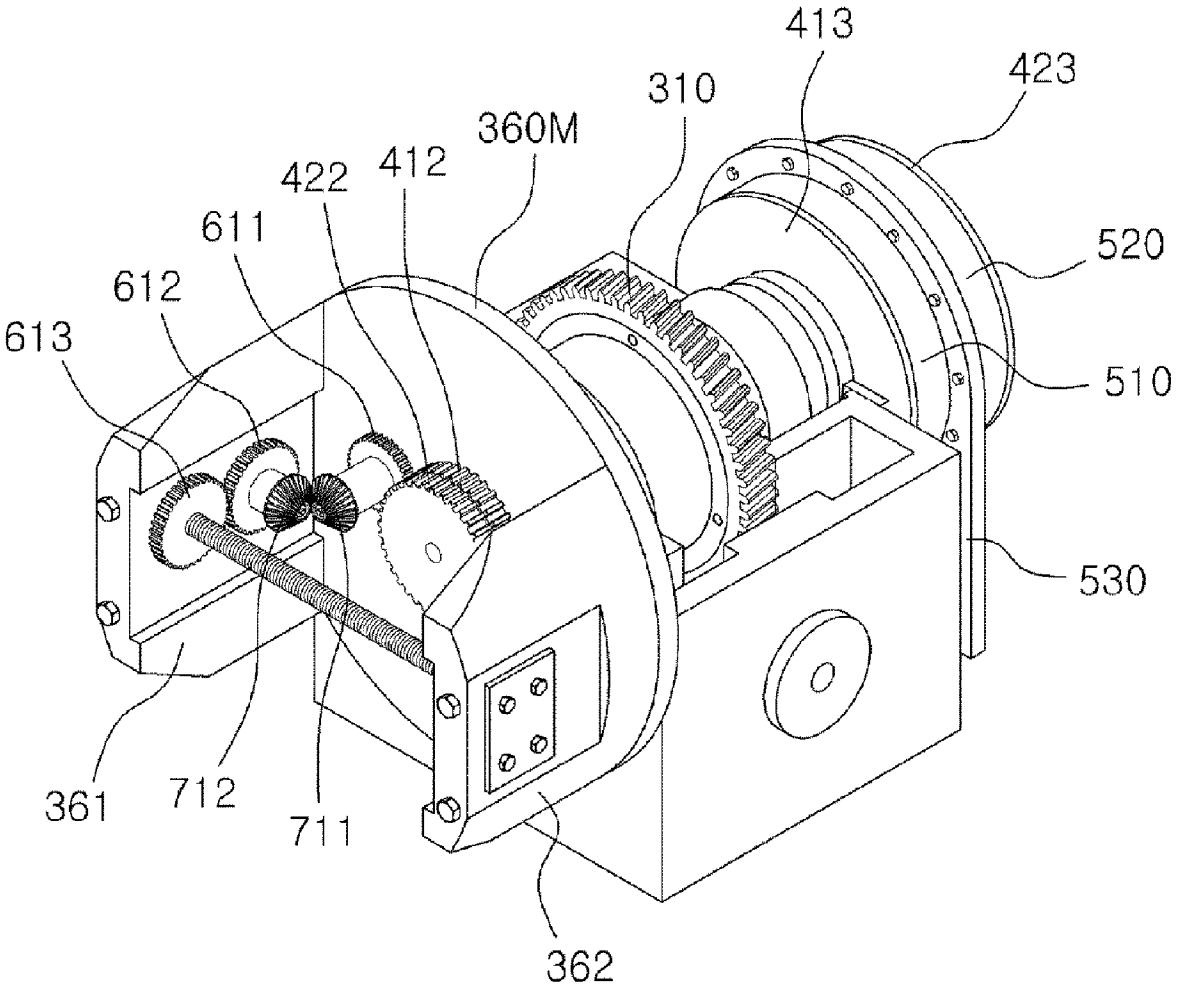
Figure 7:
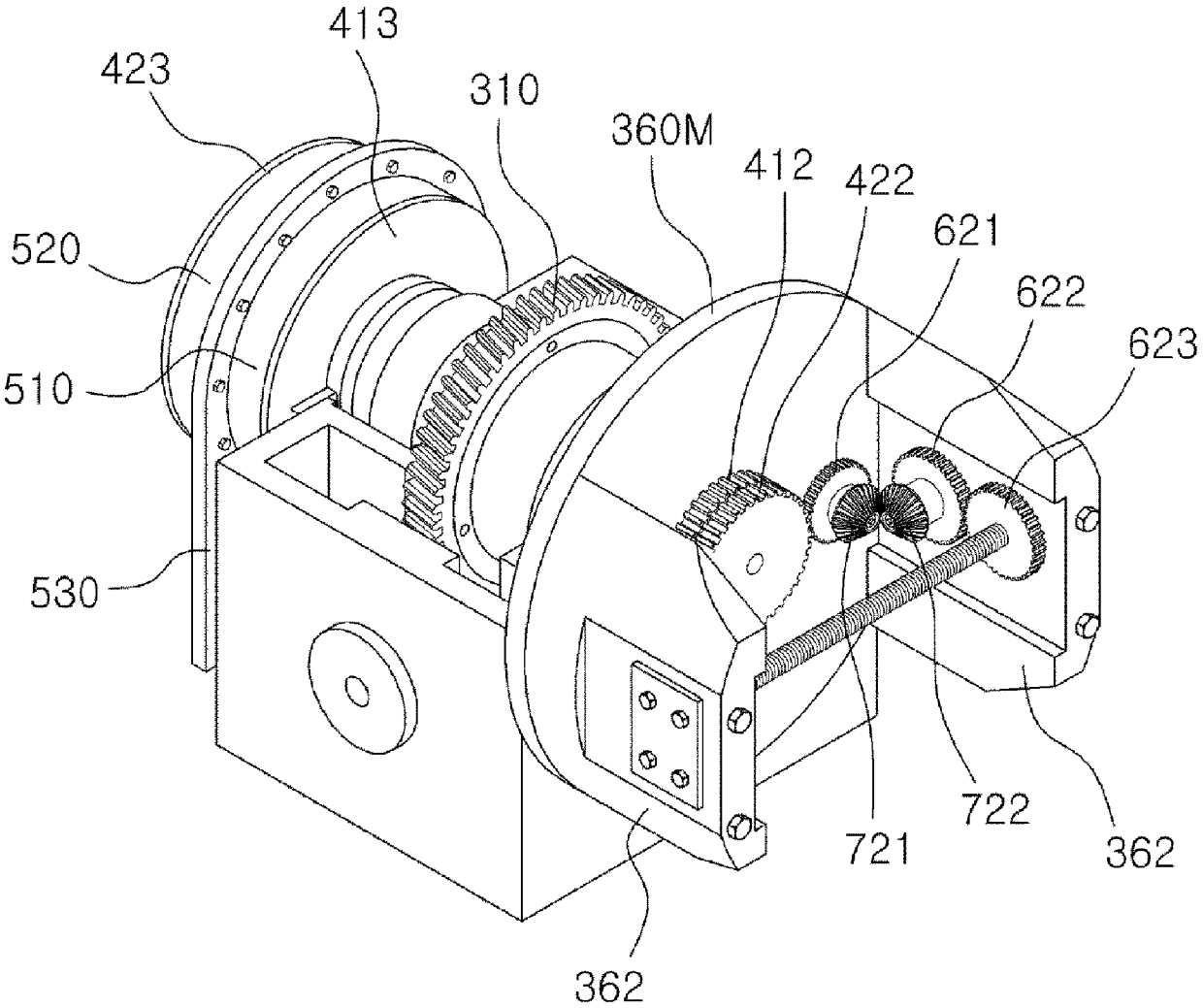

Referring to FIGS. 6 and 7, a 1-1st operation gear 611 is rotatably installed at the outer surface of the rotating plate 360M. The 1-1st operation gear 611 is engaged with the first sub gear 412. A 1-1st bevel gear 711 is integrally formed at an outer surface of the 1-1st operation gear 611. Therefore, when the 1-1st operation gear 611 is rotated, the 1-1st bevel gear 711 is rotated together.

Referring to FIGS. 6 and 7, a 1-2nd operation gear 612 is rotatably installed at an inner surface of the first main installing protrusion 361. A 1-2nd bevel gear 712 is integrally formed at an outer surface of the 1-2nd operation gear 612. The 1-2nd bevel gear 712 is engaged with the 1-1st bevel gear 711. A 1-3rd operation gear 613 is rotatably installed at an inner surface of the first main installing protrusion 361. Meanwhile, the 1-3rd operation gear 613 is engaged with the 1-2nd operation gear 612.

Further, referring to FIG. 7, a 2-1st operation gear 621 is rotatably installed at the outer surface of the rotating plate 360M. The 2-1st operation gear 621 is engaged with the second sub gear 422. A 2-1st bevel gear 721 is integrally formed at an outer surface of the 2-1st operation gear 621. Therefore, when the 2-1st operation gear 621 is rotated, the 2-1st bevel gear 721 is rotated together.

Referring to FIGS. 6 and 7, a 2-2nd operation gear 622 is rotatably installed at an inner surface of the second main installing protrusion 362. A 2-2nd bevel gear 722 is integrally formed at an outer surface of the 2-2nd operation gear 622. The 2-2nd bevel gear 722 is engaged with the 2-1st bevel gear 721. A 2-3rd operation gear 623 is rotatably installed at an inner surface of the second main installing protrusion 362. Meanwhile, the 2-3rd operation gear 623 is engaged with the 2-2nd operation gear 622.

Referring to FIG. 7, one end of a guide shaft 810 is connected to the 1-3rd operation gear 613, and the other end thereof is connected to the 2-3rd operation gear 623. Therefore, the guide shaft 810 is integrally rotated together with the 1-3rd operation gear 613 and the 2-3rd operation gear 623. Meanwhile, a screw thread is formed on an outer circumferential surface of the guide shaft 810.

Figure 8:
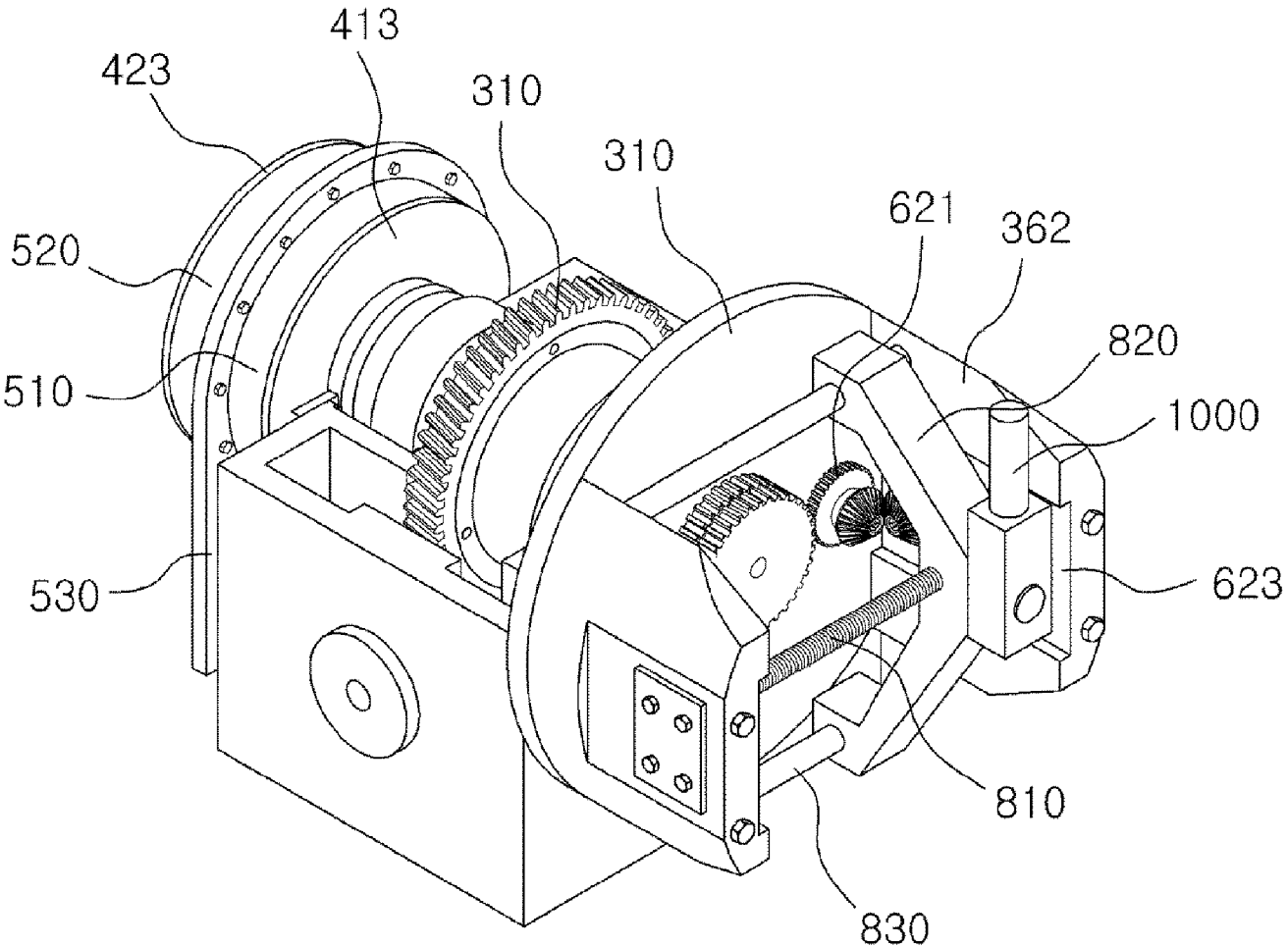

Referring to FIG. 8, a screw thread is also formed in a moving body 820 so as to be corresponding to the screw thread of the guide shaft 810. Due to the screw threads, the moving body 820 can be inserted onto the outer circumferential surface of the guide shaft 810.

Referring to FIG. 8, a guide rod 830 is fixed to each inner surface of the first and second main installing protrusions 361 and 362. And both side portions of the moving body 820 are inserted onto the guide rod 830.

With reference to FIG. 8, the operating mechanism of the first moving unit U1 will be described.

While the current is not supplied to the first and second rotation stoppers 510 and 520, the external driving force is applied to the worm 210. The worm wheel 310 engaged with the worm 210 is rotated by the rotation of the worm 210, and thus the rotating plate 360M is also rotated. Meanwhile, the first and second sub rotating bodies 410 and 420 are installed so as to be rotatable with respect to the main rotating body 300. Therefore, when the rotating plate 360M is rotated, the 1-1st and 2-1st operation gears 611 and 621 are started to rotate with respect to the rotating plate 360M, and the first and second sub gears 412 and 422 engaged with the 1-1st and 2-1st operation gears 611 and 621 are also rotated. Since the 1-1st operation gear 611 is held in the stopped stated with respect to the rotating plate 360M, the power which is transmitted in turn from the 1-1st operation gear 611 to the 1-1st bevel gear 711, the 1-2nd bevel gear 712, the 1-2nd operation gear 612, the 1-3rd operation gear 613 and the guide shaft 810 is not generated. In the same way, since the 2-1st operation gear 621 is held in the stopped stated with respect to the rotating plate 360M, the power which is transmitted in turn from the 2-1st operation gear 621 to the 2-1st bevel gear 721, the 2-2nd bevel gear 722, the 2-2nd operation gear 622, the 2-3rd operation gear 623 and the guide shaft 810 is not also generated. Therefore, the moving body 820 is also held in the stopped stated with respect to the guide shaft 810.

That is, the moving body 820 is not moved along the guide shaft 810, but held in the stopped stated with respect to the rotating plate 360M and also integrally rotated with the rotating plate 360M. Thus, the moving body 820 can carry out a circular movement having a certain rotational center and a certain rotational radius.

If the current is supplied to the first rotation stopper 510 while the moving body 820 carries out the circular movement having the certain rotational radius, the rotation of the first sub gear 412 is stopped. However, since the rotating plate 360M is still rotated, the 1-1st operation gear 611 is independently rotated with respect to the rotating plate 360M when the first sub gear 412 is stopped. If the 1-1st operation gear 611 is rotated with respect to the rotating plate 360M, the 1-1st bevel gear 711, the 1-2nd bevel gear 712, the 1-2nd operation gear 612, the 1-3rd operation gear 613 and the guide shaft 810 are respectively rotated with respect to the rotating plate 360M. If the guide shaft 810 is rotated with respect to the rotating plate 360M, the moving body 820 is moved along the guide shaft 810. In other words, since the moving body 820 is rotated together with the rotating plate 360M and also moved along the guide shaft 810, the moving body 820 carries out a circular movement having a variable rotational radius.

Therefore, if the current is selectively supplied to one of the first and second rotation stoppers 510 and 520 while the worm wheel 310 is rotated, the rotational radius of the moving body 820 which performs the circular movement can be freely changed while the moving body 820 is being rotated.

Accordingly, if one end of the crank shaft 1000 is fixed to the moving body 820 and the other end thereof is fixed to a moving plate on which a user can ride, it can be used as a driving device of a robot for virtual reality experience. In other words, the crank shaft 1000 is moved up and down (in a z-axial direction) according to the rotation of the moving body 820 and also moved left and right (in a y-axial direction) according as the moving body 820 is moved along the guide shaft 810.

Meanwhile, because the rotational radius of the moving body 820 which performs the circular movement can be freely changed while the moving body 820 is being rotated, when it is used as the driving device of the two crank shafts 1000 which are connected to the front (left) and rear (right) sides of the moving plate of the robot for virtual reality experience, in which a user can ride, there is an advantage in that a wave generated in the moving plate of the robot for virtual reality experience can be continuously and smoothly changed in real time only with driving of the worm wheel 310 and operation of the first and second rotation stoppers 510 and 520.

Meanwhile, one end of the guide shaft 810 is integrally connected with the outer surface of the 1-2nd bevel gear 712 and the other end thereof is integrally connected with the outer surface of the 2-2nd bevel gear 722 so that the guide shaft 810 is integrally rotated with the 1-2nd and 2-2nd bevel gears 712 and 722. Therefore, unlike the above-mentioned description, the 1-3rd operation gear 613 and the 2-3rd operation gear 623 may be not provided.

Second Embodiment of the First or Second Moving Unit

Figure 9:
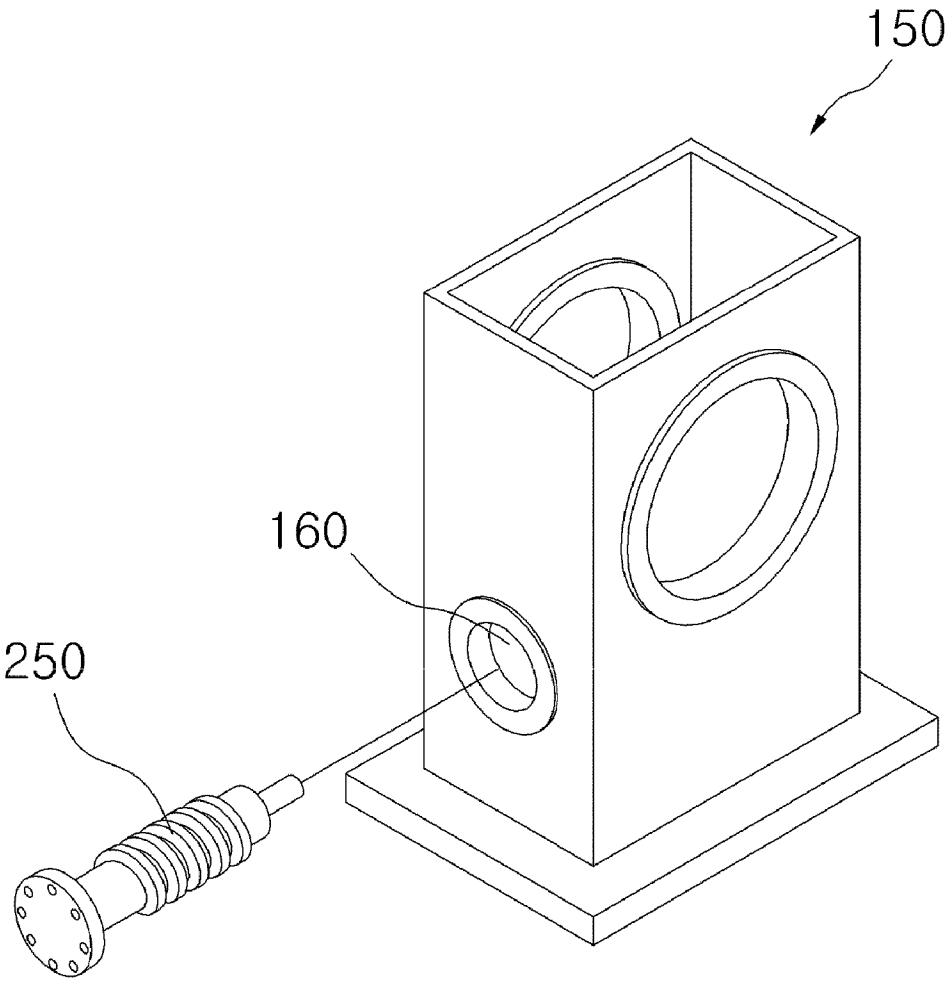
FIGS. 9 to 11 are partially exploded perspective views of another first or second moving unit of the present invention.
Figure 10:
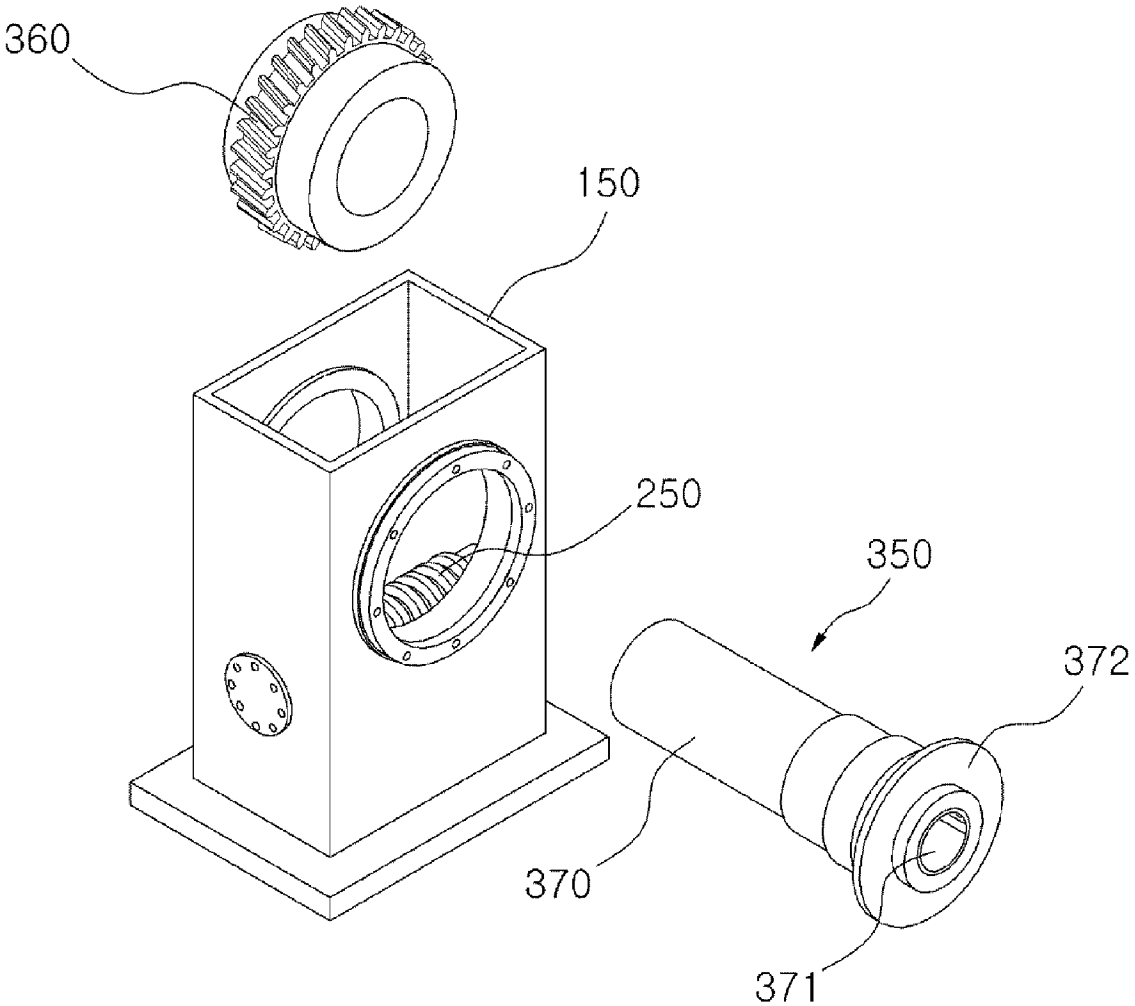

Referring to FIGS. 9 and 10, other first and second moving units U1 and U2 of the present invention are provided with a rotation supporting body 150. A worm 250 which is rotatable by external driving force is installed in the rotation supporting body 150. In order to install the worm 250, a hole 160 is formed at the rotation supporting body 150. Therefore, the driving force is transferred form an outside to the worm 250 by using a motor or the like, and thus the worm 250 can be smoothly rotated.

Figure 11:
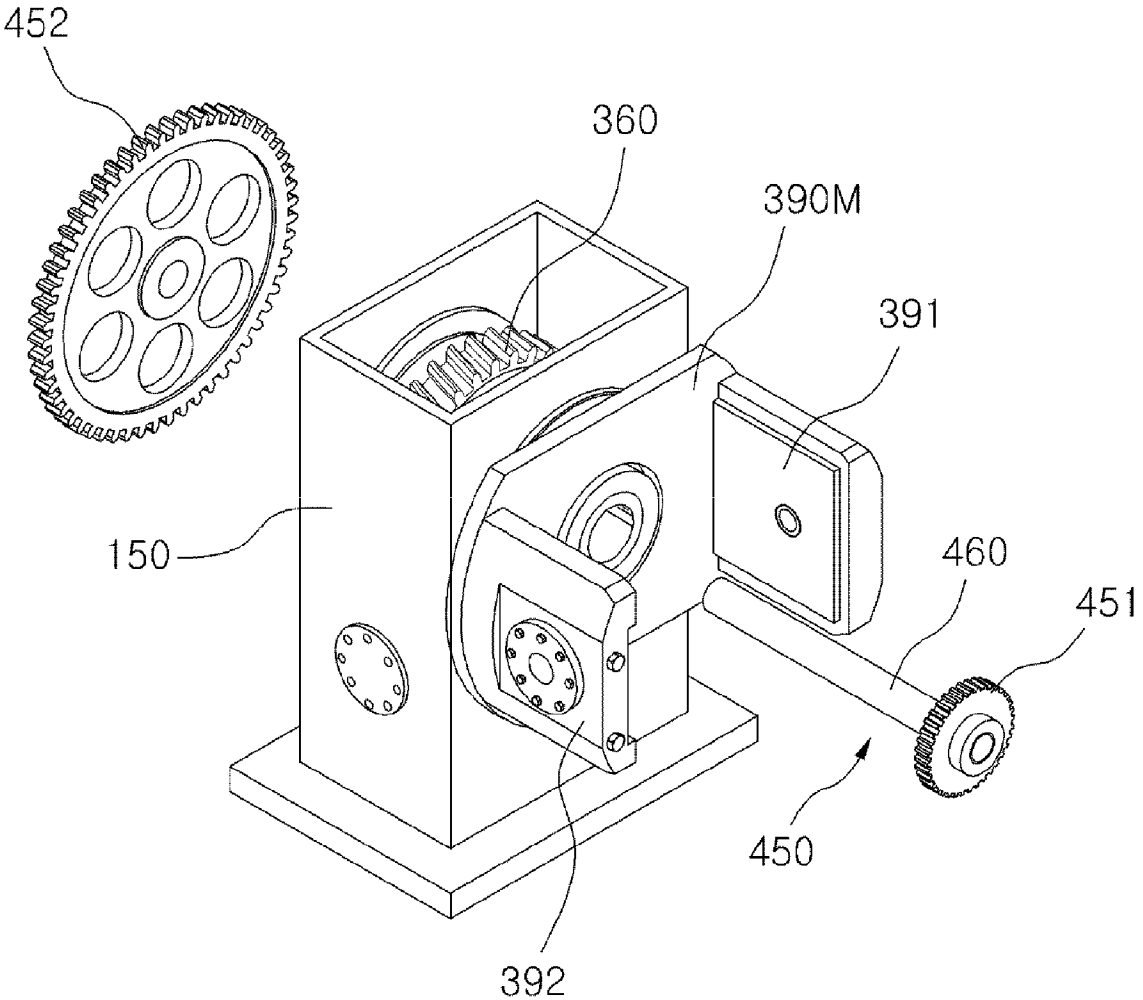

Referring to FIGS. 10 and 11, a main rotating body 350 is rotatably installed at the rotation supporting body 150 so as to be interlocked with rotation of the worm 250. The main rotating body 350 includes a worm wheel 360 engaged with the worm 250, a lock nut (not shown), an insertion shaft 370, a rotating plate 390M, a first main installing protrusion 391 and a second main installing protrusion 392, and the like.

Referring to FIG. 10, a worm wheel inserting hole is formed in a center portion of the worm wheel 360. The insertion shaft 370 is inserted and fixed into the worm wheel inserting hole so as to be integrally rotated with the worm wheel 360. A stopping portion 372 is formed to be protruded on an outer circumferential surface of one end of the insertion shaft 370. Meanwhile, a main through-hole 371 is axially formed in a center portion of the insertion shaft 370.

Referring to FIG. 10, the insertion shaft 370 is supported by the rotation supporting body 150 and also supported to be rotatable about the worm wheel 360 in the center. And, a first oil sealing member (not shown), the lock nut (not shown) and a second oil sealing member (not shown) are the same as those in the first embodiment.

Referring to FIGS. 10 and 11, a rotating plate 390M is coupled to the outer circumferential surface of the one end of the insertion shaft 370 so as to be integrally rotated with the insertion shaft 370. Meanwhile, the first main installing protrusion 391 and the second main installing protrusion 392 are formed on an outer surface of the rotating plate 390M so as to be protruded in a vertical direction to the rotating plate 360M. The first main installing protrusion 391 and the second main installing protrusion 392 are formed to be opposed to each other with the main through-hole 371 in the center.

Referring to FIGS. 10 and 11, a sub rotating body 450 is rotatably installed in the main rotating body 350. The sub rotating body 450 includes a sub rotating shaft 460 which is rotatably inserted into the main through-hole 371. A sub gear 451 is disposed at an outer circumferential surface of one end of the sub rotating shaft 460. The sub gear 460 is located at an outer side of the rotating plate 390M. Meanwhile, a first control gear 452 is integrally coupled to the other end of the sub rotating shaft 460. The first control gear 452 is located at an outer side of the other end of the main rotating body 350.

Figure 12:
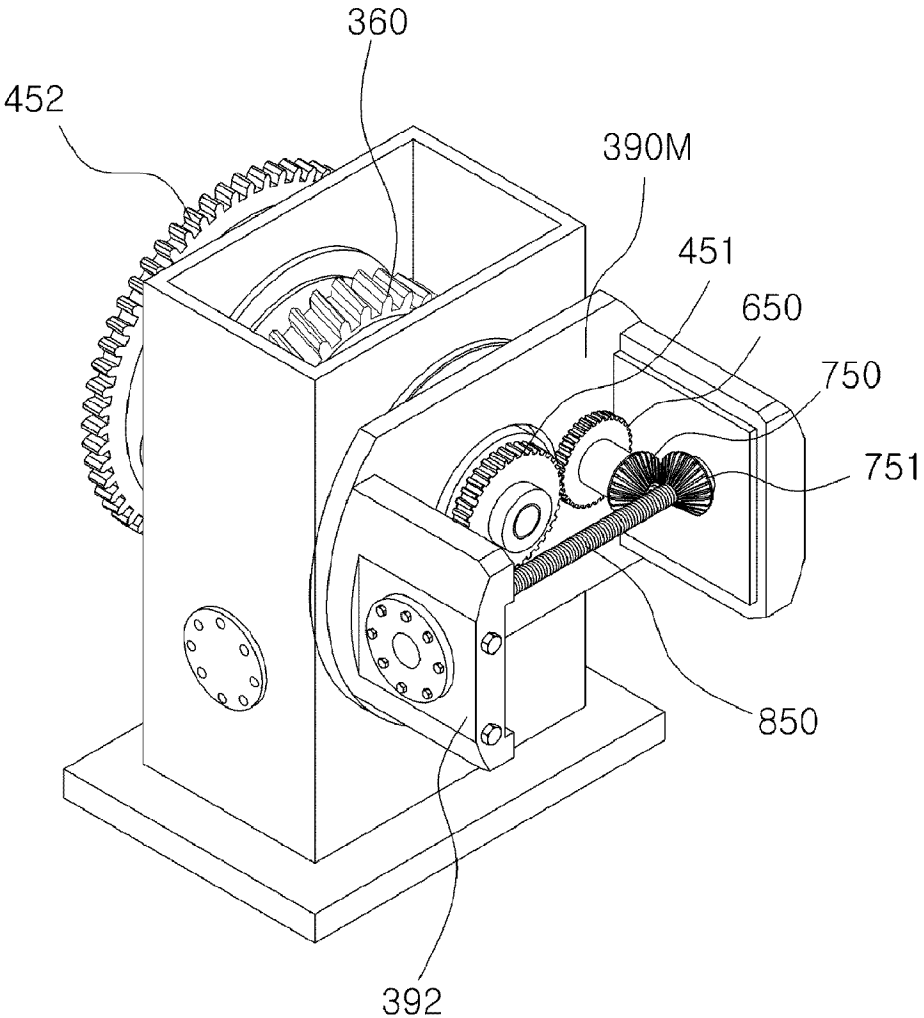
FIGS. 12 to 14 are perspective views of a main part of the another first or second moving unit of the present invention.
Figure 14:
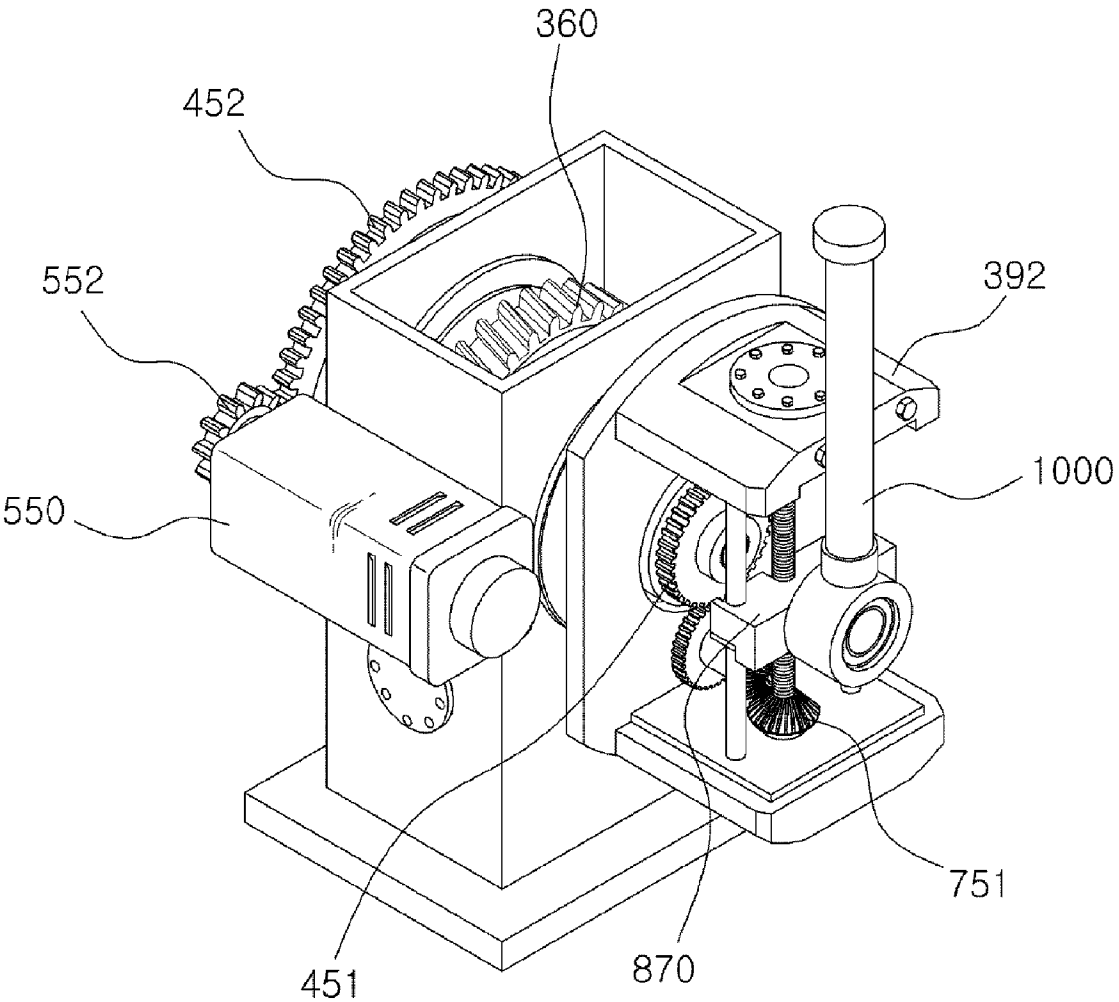

Referring to FIGS. 12 and 14, there is provided a control motor 550 having a second control gear 552 for controlling rotation of the first control gear 452. Preferably, the control motor 550 is fixed to one side of the rotation supporting body 150. The rotation of the first control gear 452, the sub gear 451 and an operation gear 650 engaged with the sub gear 451 is determined according to whether or not power is applied to the control motor 550.

Referring to FIG. 12, an operation gear 650 is rotatably installed at the outer surface of the rotating plate 390M. The operation gear 650 is engaged with the sub gear 451. A first bevel gear 750 is integrally formed at an outer surface of the operation gear 650. Therefore, when the operation gear 650 is rotated, the first bevel gear 750 is rotated together.

Figure 13:
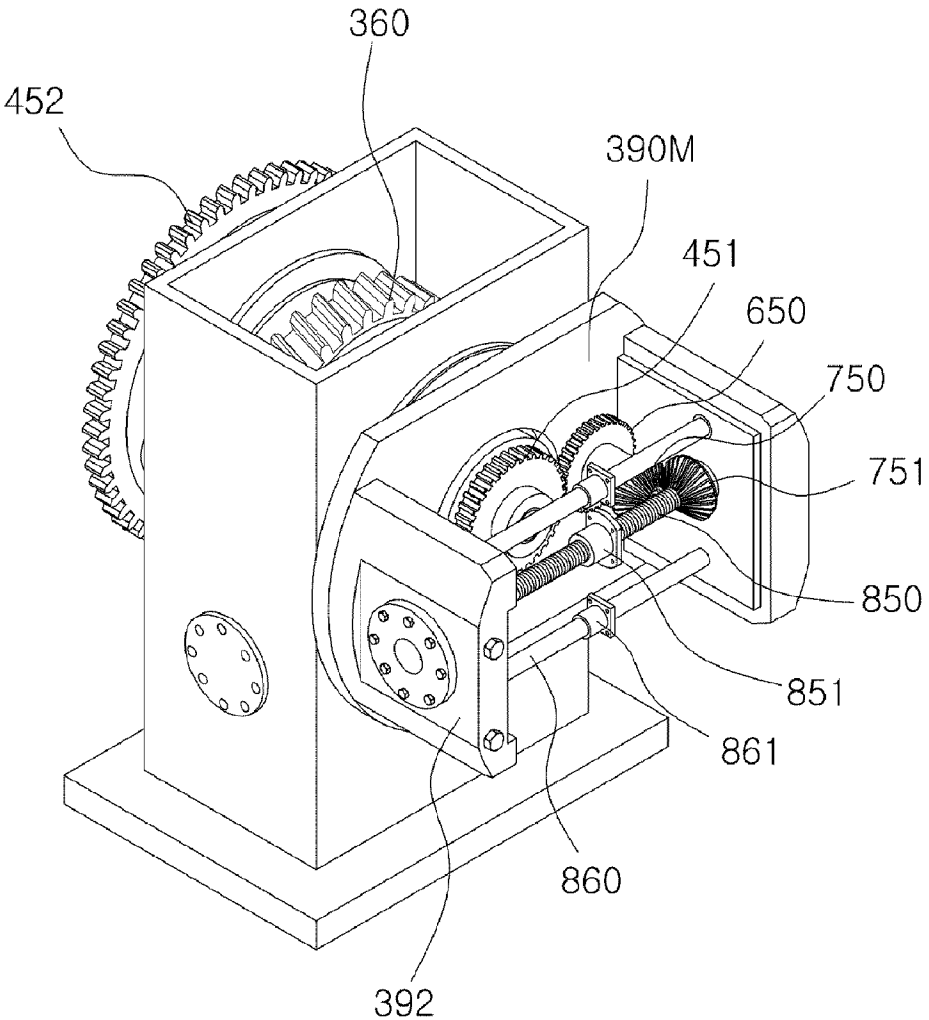

Referring to FIG. 13, a second bevel gear 751 is rotatably installed at an inner surface of one of the first and second main installing protrusions 391 and 392. The first bevel gear 750 is engaged with the second bevel gear 751.

Referring to FIG. 13, one end of the guide shaft 850 is connected to the second bevel gear 751, and the other end thereof is connected to one of the first and second main installing protrusions 391 and 392 on which the second bevel gear 751 is not provided. Therefore, the guide shaft 850 is integrally rotated with the second bevel gear 751. Meanwhile, a screw thread is formed on an outer circumferential surface of the guide shaft 850.

Referring to FIGS. 12 to 14, a screw thread is also formed in a first guide portion 851, a second guide portion 861 and a moving body 870 coupled with the first and second guide portions 851 and 861 so as to be corresponding to the screw thread of the guide shaft 850.

Referring to FIGS. 12 to 14, a guide rod 860 is fixed to each inner surface of the first and second main installing protrusions 391 and 392. And the first guide portion 851, the second guide portion 861 and the moving body 870 coupled with the first and second guide portions 851 and 861 are inserted onto the guide rod 860 and the guide shaft 850.

Referring to FIG. 14, while the current is not supplied to the control motor 550, the external driving force is applied to the worm 250. The worm wheel 360 engaged with the worm 250 is rotated by the rotation of the worm 250, and thus the rotating plate 390M is also rotated. If the rotating plate 390M is rotated, the operation gear 650 is started to rotate with respect to the rotating plate 390M, and the sub gear 451 engaged with the operation gear 650 is also rotated. Since the operation gear 650 is held in the stopped stated with respect to the rotating plate 390M, the power which is transmitted in turn from the operation gear 650 to the first bevel gear 750, the second bevel gear 751 and the guide shaft 850 is not generated. Therefore, since the guide shaft 850 is not rotated, the moving body 870 is also held in the stopped stated with respect to the guide shaft 850.

That is, the moving body 870 is not moved along the guide shaft 850, but held in the stopped stated with respect to the rotating plate 390M and also integrally rotated with the rotating plate 390M. Thus, the moving body 870 can carry out a circular movement having a certain rotational center and a certain rotational radius.

Referring to FIG. 14, if the current is supplied to the control motor 550 while the moving body 870 carries out the circular movement having the certain rotational radius, driving power of the control motor 550 is transmitted in turn to the second control gear 552, the first control gear 452, the sub gear 451, the operation gear 650, the first bevel gear 750 and the second bevel gear 751. Thus, the guide shaft 850 is also rotated, and the moving body 870 coupled with the first and second guide portions 851 and 861 is moved up and down in a length direction. That is, since the moving body 870 is rotated together with the rotating plate 390M and also moved along the guide shaft 850, the moving body 870 carries out a circular movement having a variable rotational radius.

Therefore, if one end of the crank shaft 1000 is fixed to the moving body 870 and the other end thereof is fixed to a moving plate on which a user can ride, it can be used as a driving device of a robot for virtual reality experience. In other words, the crank shaft 1000 is moved up and down (in a z-axial direction) according to the rotation of the moving body 870 and also moved left and right (in a y-axial direction) according as the moving body 870 is moved along the guide shaft 850.

Meanwhile, because the rotational radius of the moving body 870 which performs the circular movement can be freely changed while the moving body 870 is being rotated, when it is used as the driving device of the two crank shafts 1000 which are connected to the front (left) and rear (right) sides of the moving plate of the robot for virtual reality experience, in which a user can ride, there is an advantage in that a wave generated in the moving plate of the robot for virtual reality experience can be continuously and smoothly changed in real time only with driving of the worm wheel 360 and operation of the control motor 550.

Until now, the first and second moving units U1 and U2 are described with reference to FIGS. 1 to 14. Hereinafter, a crank device set which is disposed at an upper side of the first and second moving units U1 and U2 will be described with reference to FIG. 15.

First Embodiment of the Crank Device Set

Referring to FIGS. 1 to 15, the first embodiment includes a first crank 1100, a first linear guide 1130, a first horizontally moving body 1140, a first crank motor mount 1150, a first rotating plate 1170, a first rotating bar 1180, a second crank 1200, a second linear guide 1230, a second horizontally moving body 1240, a second crank motor mount 1250, a second rotating plate 1270, a second rotating bar 1280 and a settling body 1300.

Figure 15:
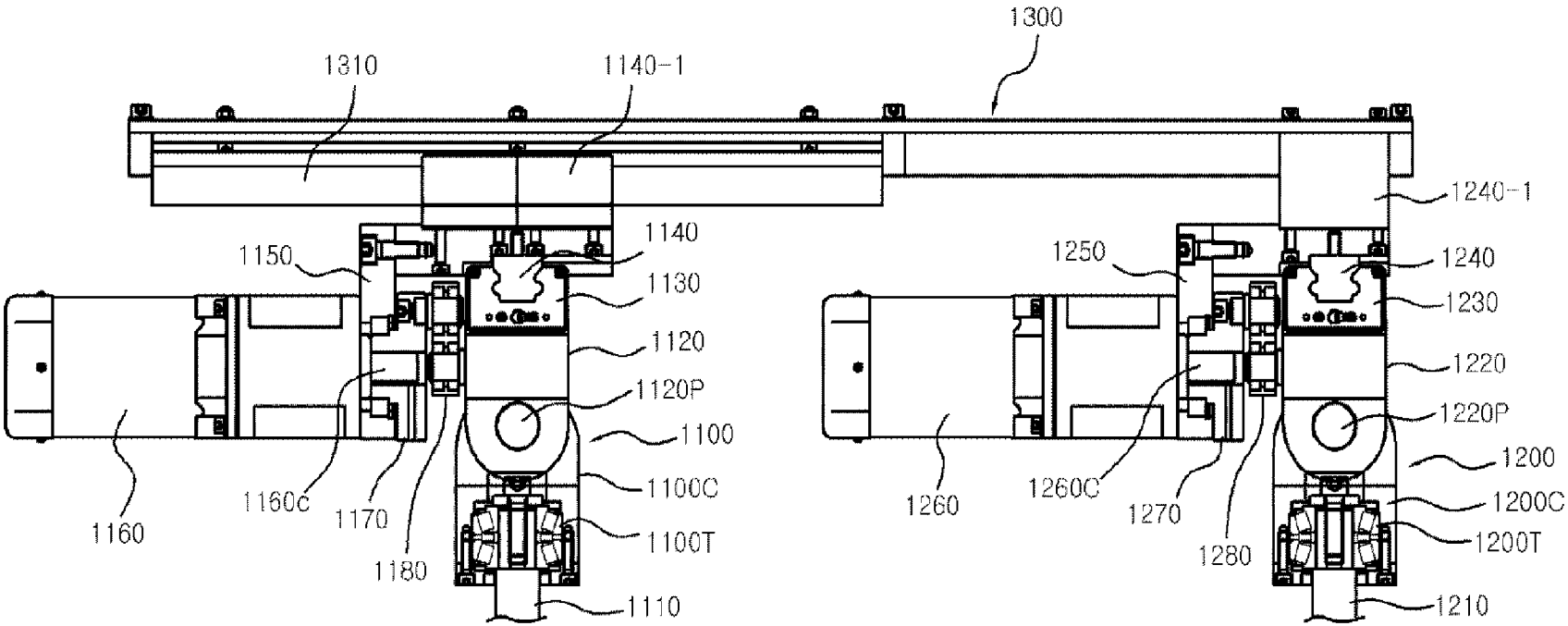
FIG. 15 is a front view of a main part of a crank device set of the present invention.

Referring to FIG. 15, the first crank 1100 includes a first lower rod 1110, a first crank connecting portion 1100C and a first upper rod 1120.

Referring to FIGS. 1 to 15, a lower end of the first lower rod 1110 is connected to the crank shaft 1000 of the first moving unit U1 so as to be moved left/right and up/down. That is, the first lower rod 1110 can be moved left and right (in a y-axial direction), moved up and down (in a z-axial direction) or simultaneously moved left/right and up/down (in the z and y-axial directions) by the first moving unit U1. Therefore, a first lower rod guiding body 1410 is inserted onto the first lower rod 1110 so as to guide the up and down movement of the first lower rod 1110. Further, a first left/right movement guiding rod 1510 is inserted into the first lower rod guiding body 1410 so as to guide the left/right movement of the first lower rod guiding body 1410 and thus guide the left/right movement of the first lower rod 1110.

Figure 16:
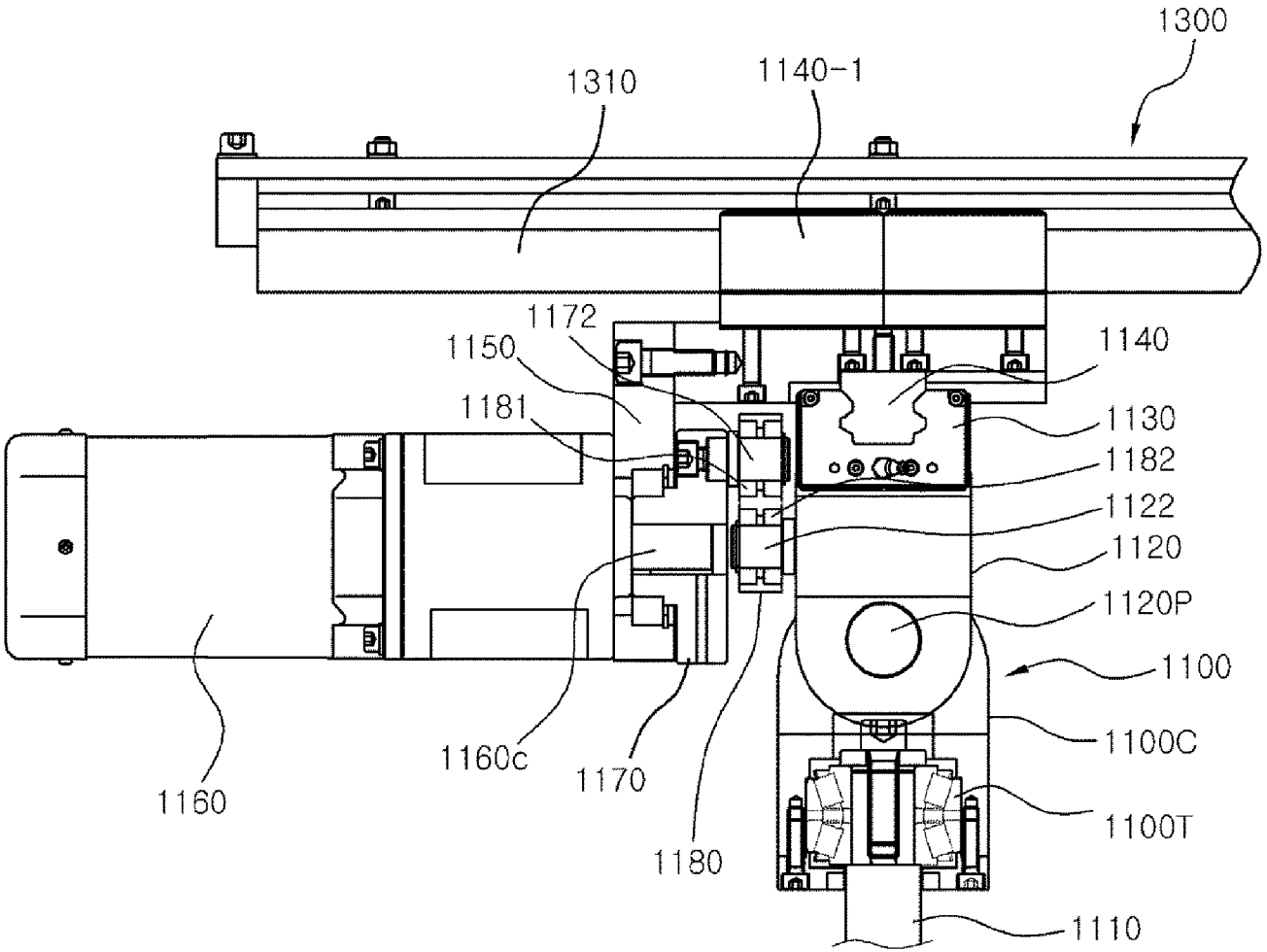
FIGS. 16 and 17 are detailed views of the main part of FIG. 15.
Figure 17:
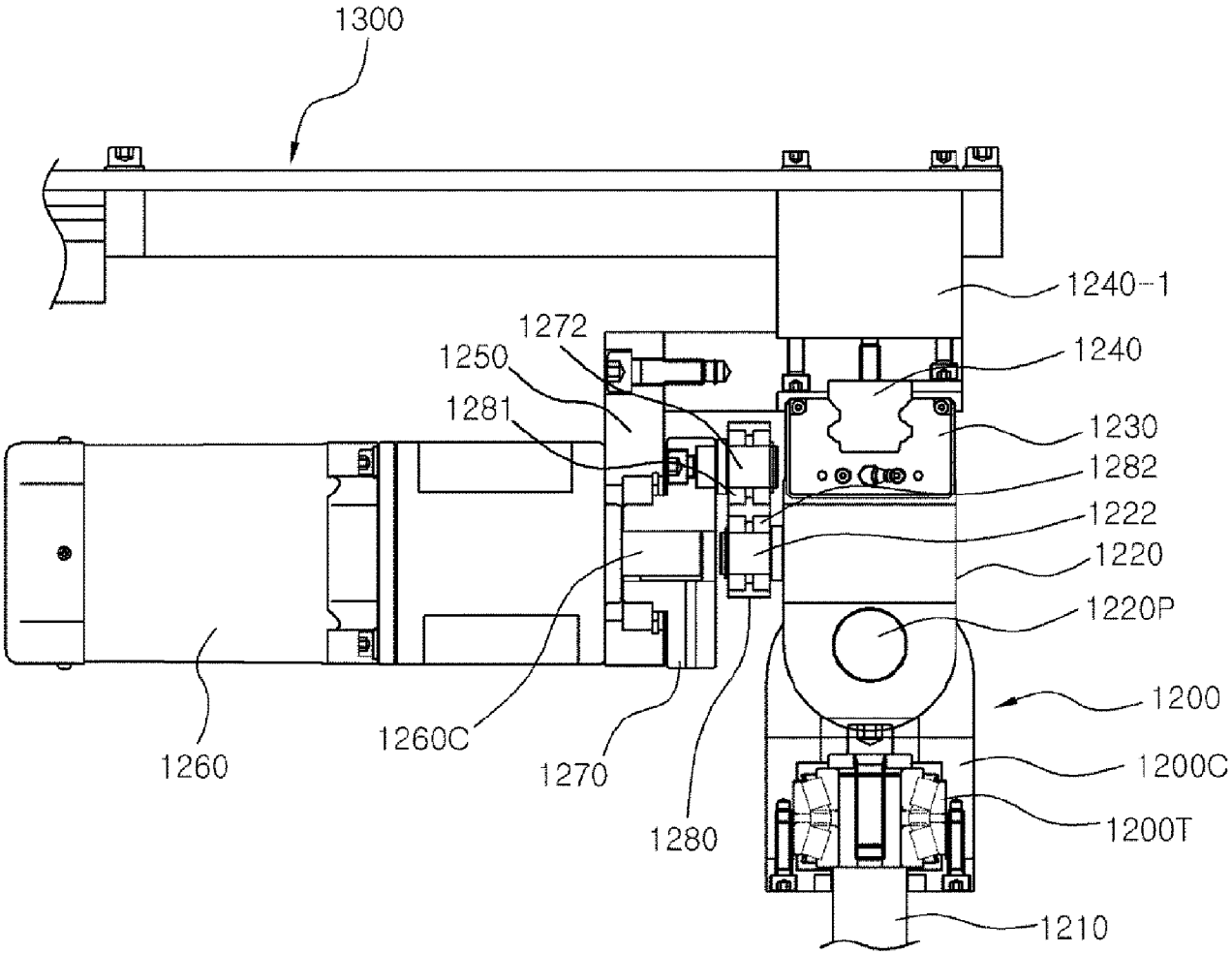

Referring to FIGS. 16 and 17, a lower end of the first crank connecting portion 1100C is connected to the first lower rod 1110 so that the first crank connecting portion 1100C can be rotated about a rotational center line thereof, which is passed through up and down. That is, the first crank connecting portion 1100C is supported by a first taper bearing 1100T mounted on the first lower rod 1110 so as to be rotatable about the rotational center line of the first crank connecting portion 1100C. Meanwhile, the rotational center line of the first crank connecting portion 1100C may be a perpendicular line which is perpendicular to a cross-section of the first lower rod 1110 and extended in a length direction of the first lower rod 1110.

Referring to FIGS. 16 and 17, a lower end of the first upper rod 1120 is connected to the first crank connecting portion 1100C so that first upper rod 1120 can be rotated about a rotational center line thereof, which is horizontally passed through. That is, the first upper rod 1120 is rotatably connected to the first crank connecting portion 1100C by a first pin 1120P which is horizontally inserted. Meanwhile, the rotational center line of the first upper rod 1120 may be a horizontal line which is perpendicular to the rotational center line of the first crank connecting portion 1100C and extended in a horizontal direction thereof.

Referring to FIGS. 16 and 17, the first linear guide 1130 is fixed to an upper end of the first upper rod 1120 so as to guide a movement in a horizontal direction which is the same as the rotational center line of the first upper rod 1120. Herein, the horizontal direction which is the same as the rotational center line of the first upper rod 1120 means a parallel direction with the rotational center line of the first upper rod 1120.

Referring to FIGS. 16 and 17, the first horizontally moving body 1140 is installed at the first linear guide 1130 so as to be guided along the first linear guide 1130 and also to be movable in the horizontal direction which is the same as the rotational center line of the first upper rod 1120.

Referring to FIGS. 16 and 17, one end of the first crank motor mount 1150 is fixed to the first horizontally moving body 1140, and the other end thereof is fixed with a first crank motor 1160.

Referring to FIG. 17, the first rotating plate 1170 is connected with a motor shaft 1160C of the first crank motor 1160. Therefore, as the motor shaft 1160C of the first crank motor 1160 is rotated when the first crank motor 1160 is operated, the first rotating plate 1170 is integrally rotated with the motor shaft 1160C.

Referring to FIGS. 16 and 17, one end of the first rotating bar 1180 is rotatably connected to the first rotating plate 1170, and the other end thereof is rotatably connected to the first upper rod 1120. And, a first rotating plate protruded shaft 1172 is formed on an outer surface of the first rotating plate 1170, and a 1-1st bearing 1181 is installed at the one end of the first rotating bar 1180 so that the one end of the first rotating bar 1180 can be relatively rotated with respect to the first rotating plate protruded shaft 1172. Further, the first upper rod 1120 is also provided with a first upper rod protruded shaft 1122 which is protruded from the first upper rod 1120 toward the first rotating bar 1180, and a 1-2nd bearing 1182 is installed at the other end of the first rotating bar 1180 so that the other end of the first rotating bar 1180 can be relatively rotated with respect to the first upper rod protruded shaft 1122. Thus, as the motor shaft 1160C of the first crank motor 1160 is rotated when the first crank motor 1160 is operated, the first horizontally moving body 1140 is guided along the first linear guide 1130. Meanwhile, the first upper rod protruded shaft 1122 is disposed to be not located on the same straight line as the motor shaft 1160C of the first crank motor 1160 regardless of any relative position between the first horizontally moving body 1140 and the first linear guide 1130, such that the first horizontally moving body 1140 can be always guided along the first linear guide 1130 when the first crank motor 1160 is operated.

Referring to FIG. 16, the second crank 1200 includes a second lower rod 1210, a second crank connecting portion 1200C and a second upper rod 1220. Referring to FIGS. 1 and 15, a lower end of the second lower rod 1210 is connected to the crank shaft 1000 of the second moving unit U2 so as to be moved left/right and up/down.

Referring to FIG. 15, the lower end of the second lower rod 1210 is connected to the crank shaft 1000 of the second moving unit U2 of a robot for virtual reality experience so as to be moved left/right and up/down, and the second lower rod 1210 is parallelly spaced apart from the first lower rod 1110 in a desired distance. That is, the second lower rod 1210 can be moved left and right, moved up and down or simultaneously moved left/right and up/down by the second moving unit U2. Therefore, a second lower rod guiding body 1420 is inserted onto the second lower rod 1210 so as to guide the up and down movement of the second lower rod 1210. Further, a second left/right movement guiding rod 1520 is inserted into the second lower rod guiding body 1420 so as to guide the left/right movement of the second lower rod guiding body 1420 and thus guide the left/right movement of the second lower rod 1210.

Figure 18:
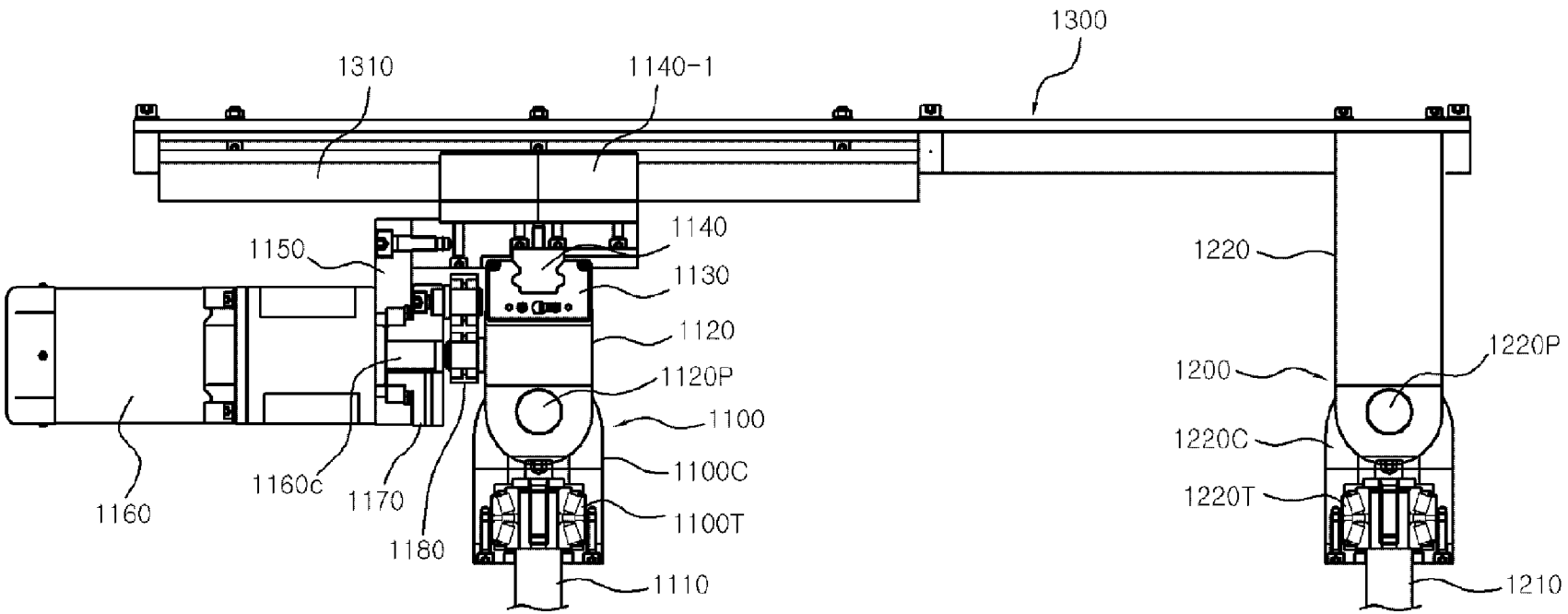
FIG. 18 is a front view of a main part of another crank device set of the present invention.

Referring to FIGS. 16 to 18, a lower end of the second crank connecting portion 1200C is connected to the second lower rod 1210 so that the second crank connecting portion 1200C can be rotated about a rotational center line thereof, which is passed through up and down. That is, the second crank connecting portion 1200C is supported by a second taper bearing 1200T mounted on the second lower rod 1210 so as to be rotatable about the rotational center line of the second crank connecting portion 1200C. Meanwhile, the rotational center line of the second crank connecting portion 1200C is a straight line which is parallel with the rotational center line of the first crank connecting portion 1100C and may be a perpendicular line which is perpendicular to a cross-section of the second lower rod 1210 and extended in a length direction of the second lower rod 1210.

Referring to FIGS. 16 to 18, a lower end of the second upper rod 1220 is connected to the second crank connecting portion 1200C so that the second upper rod 1220 can be rotated about a rotational center line thereof, which is horizontally passed through. That is, the second upper rod 1220 is rotatably connected to the second crank connecting portion 1200C by a second pin 1220P which is horizontally inserted. Meanwhile, the rotational center line of the second upper rod 1220 is a straight line which is parallel with the rotational center line of the first upper rod 1120 and may be a horizontal line which is perpendicular to the rotational center line of the second crank connecting portion 1200C and extended in a horizontal direction thereof.

Referring to FIGS. 16 to 18, the second linear guide 1230 is fixed to an upper end of the second upper rod 1220 so as to guide a movement in a horizontal direction which is the same as the rotational center line of the second upper rod 1220. Herein, the horizontal direction which is the same as the rotational center line of the second upper rod 1220 means a parallel direction with the rotational center line of the second upper rod 1220.

Referring to FIGS. 16 to 18, the second horizontally moving body 1240 is installed at the second linear guide 1230 so as to be guided along the second linear guide 1230 and also to be movable in the horizontal direction which is the same as the rotational center line of the second upper rod 1220.

Referring to FIGS. 16 to 18, one end of the second crank motor mount 1250 is fixed to the second horizontally moving body 1240, and the other end thereof is fixed with a second crank motor 1260.

Referring to FIGS. 16 to 18, the second rotating plate 1270 is connected with a motor shaft 1260C of the second crank motor 1260. Therefore, as the motor shaft 1260C of the second crank motor 1260 is rotated when the second crank motor 1260 is operated, the second rotating plate 1270 is integrally rotated with the motor shaft 1260C.

Referring to FIG. 18, one end of the second rotating bar 1280 is rotatably connected to the second rotating plate 1270, and the other end thereof is rotatably connected to the second upper rod 1220. And, a second rotating plate protruded shaft 1272 is formed on an outer surface of the second rotating plate 1270, and a 2-1st bearing 1281 is installed at the one end of the second rotating bar 1280 so that the one end of the second rotating bar 1280 can be relatively rotated with respect to the second rotating plate protruded shaft 1272. Further, the second upper rod 1220 is also provided with a second upper rod protruded shaft 1222 which is protruded from the second upper rod 1220 toward the second rotating bar 1280, and a 2-2nd bearing 1282 is installed at the other end of the second rotating bar 1280 so that the other end of the second rotating bar 1280 can be relatively rotated with respect to the second upper rod protruded shaft 1222. Thus, as the motor shaft 1260C of the second crank motor 1260 is rotated when the second crank motor 1260 is operated, the second horizontally moving body 1240 is guided along the second linear guide 1230. Meanwhile, the second upper rod protruded shaft 1222 is disposed to be not located on the same straight line as the motor shaft 1260C of the second crank motor 1260 regardless of any relative position between the second horizontally moving body 1240 and the second linear guide 1230, such that the second horizontally moving body 1240 can be always guided along the second linear guide 1230 when the second crank motor 1260 is operated.

Referring to FIGS. 16 to 18, a first moving body guiding rod 1310 is formed at one side of the settling body 1300, and the first horizontally moving body 1140 is connected to the first moving body guiding rod 1310 so as to be slidable in a perpendicular direction to a guiding direction of the first linear guide 1130. A tubular slider 1140-1 is installed at the first moving body guiding rod 1310, and thus the first horizontally moving body 1140 can be slidably coupled to the first moving body guiding rod 1310. Meanwhile, the second horizontally moving body 1240 is fixedly connected to the other side of the settling body 1300. A connecting portion 1240-1 for second horizontally moving body, which is fixed to the second crank motor mount 1250, is fixed to the settling body 1300, and thus the second horizontally moving body 1240 can be fixedly connected to the settling body 1300. Hereinafter, the operation of the crank device set will be described.

Referring to FIGS. 1 to 16, the first lower rod 1110 can be moved left and right, moved up and down or simultaneously moved left/right and up/down according to an operation state of the first moving unit U1. In the same way, the second lower rod 1210 can be moved left and right, moved up and down or simultaneously moved left/right and up/down according to an operation state of the second moving unit U2.

Referring to FIG. 16, the first horizontally moving body 1140 is slidably coupled to the first moving body guiding rod 1310 through the slider 1140-1, and the second horizontally moving body 1240 is slidably coupled to the settling body 1300 through the connecting portion 1240-1 for second horizontally moving body. Therefore, the settling body 1300 can be moved left and right, moved up and down or simultaneously moved left/right and up/down so as to form different waveforms according to the operation state of the first and second moving units U1 and U2.

Referring to FIGS. 16 to 18, the first crank connecting portion 1100C is connected to the first lower rod 1110 so as to be rotatable about the rotational center line of the first crank connecting portion 1100C, and the second crank connecting portion 1200C is connected to the second lower rod 1210 so as to be rotatable about the rotational center line of the second crank connecting portion 1200C. Therefore, when the first crank motor 1160 is operated, the first horizontally moving body 1140 is guided along the first linear guide 1130, and when the second crank motor 1260 is operated, the second horizontally moving body 1240 is guided along the second linear guide 1230. That is, according to the operation state of the first and second crank motors 1160 and 1260, the settling body 1300 creates movements having various waveforms which pass through planes (for example, a paper surface of FIG. 2) formed by the first and second lower rods 1110 and 1210.

Therefore, referring to FIG. 16, the settling body 1300 can be moved in various waveforms having various directions and sizes according to the operation states of the first and second moving units U1 and U2 (referring to FIG. 1) and the first and second crank motors 1160 and 1260.

Second Embodiment of the Crank Device Set

Hereinafter, another crank device set of the robot for virtual reality experience according to the present invention will be described.

Figure 19:
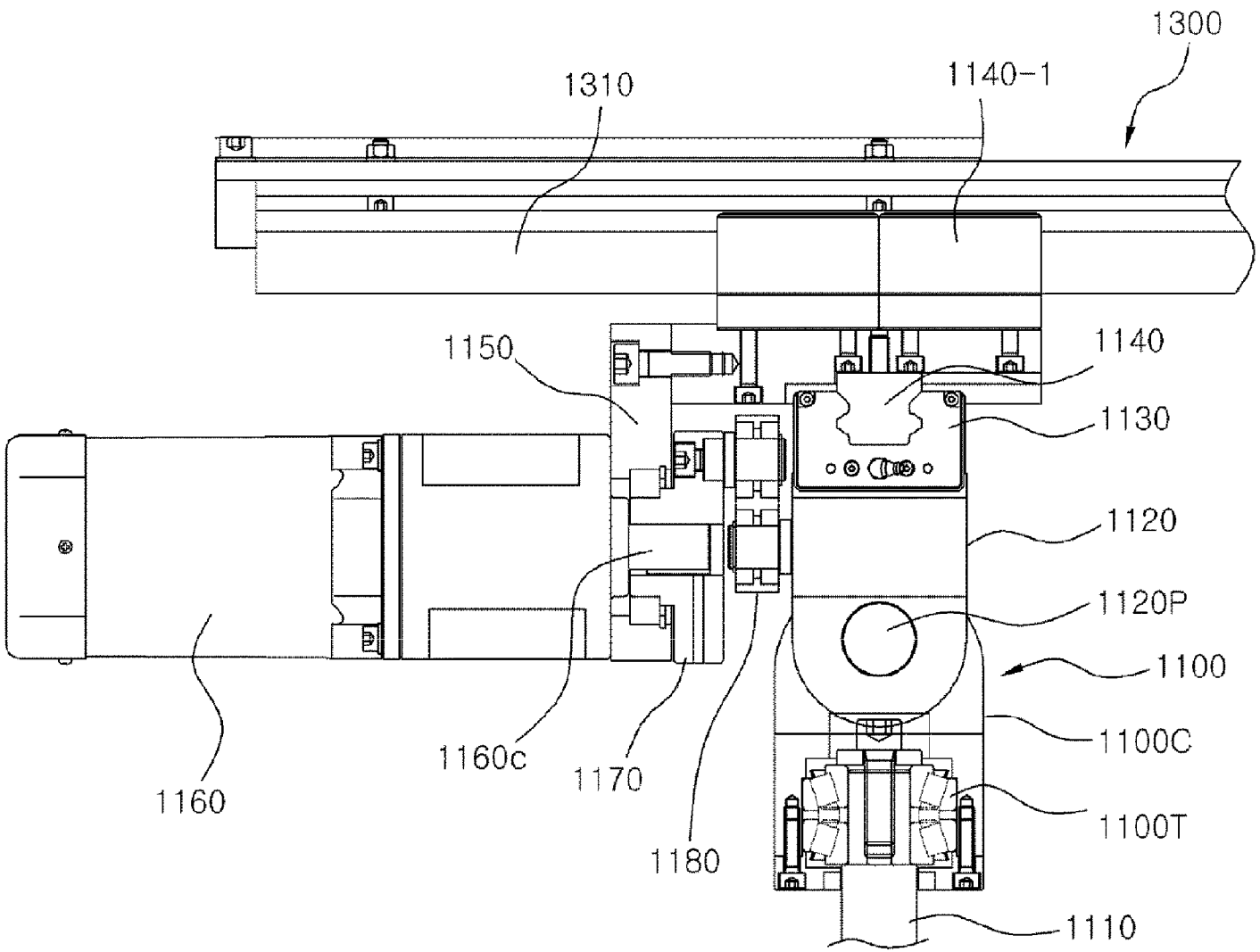
FIGS. 19 and 20 are detailed views of the main part of FIG. 18.

Referring to FIGS. 15 and 19, like in the first embodiment, the crank device set according to the second embodiment includes a first crank 1100, a first linear guide 1130, a first horizontally moving body 1140, a first crank motor mount 1150, a first rotating plate 1170, a first rotating bar 1180, a second crank 1200 and a settling body 1300.

Referring to FIG. 19, like in the first embodiment, the first crank 1100 includes a first lower rod 1110, a first crank connecting portion 1100C and a first upper rod 1120.

Referring to FIG. 1, like in the first embodiment, a lower end of the first lower rod 1110 is connected to the first moving unit U1 so as to be moved left/right and up/down. Further, a first lower rod guiding body 1410 is inserted onto the first lower rod 1110, and a first left/right movement guiding rod 1510 is inserted into the first lower rod guiding body 1410.

Figure 20:
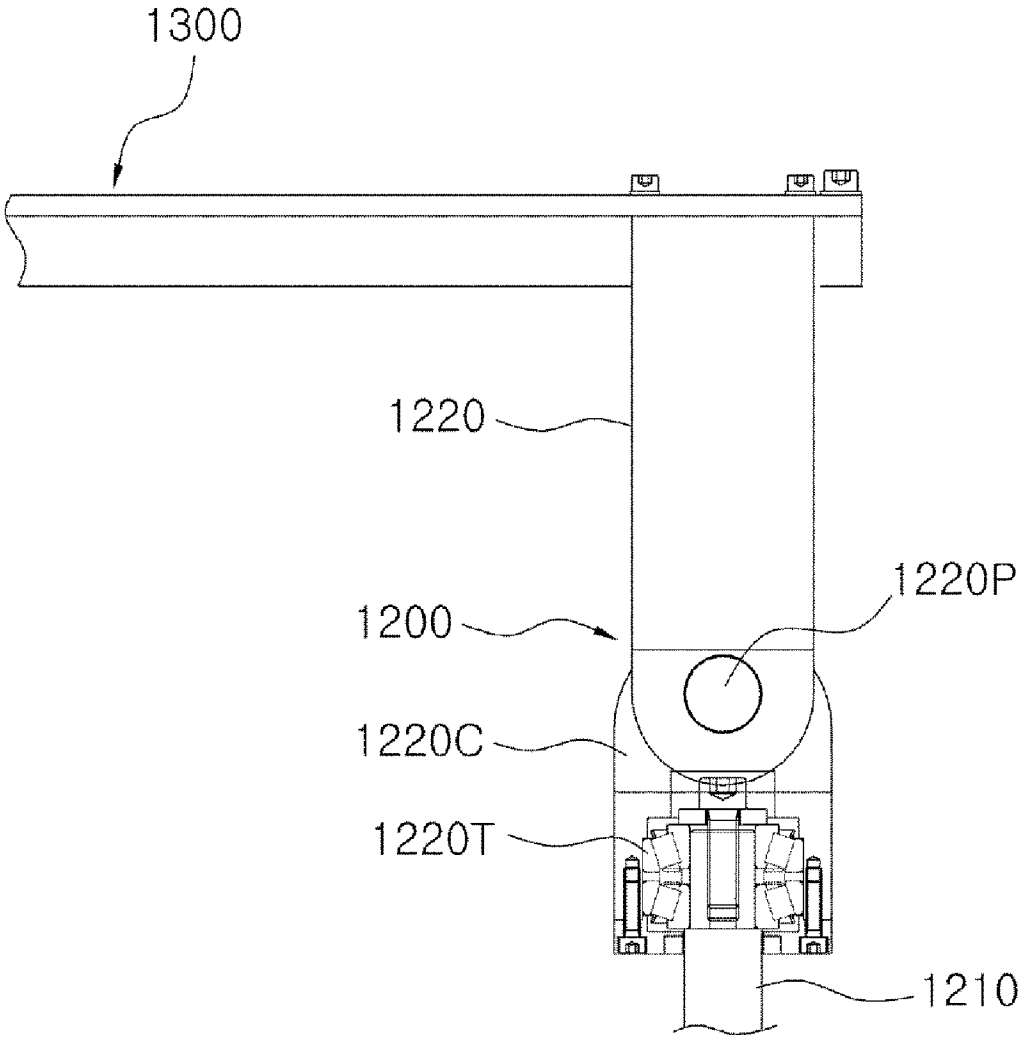

Referring to FIGS. 19 and 20, like in the first embodiment, a lower end of the first crank connecting portion 1100C is connected to the first lower rod 1110 so that the first crank connecting portion 1100C can be rotated about a rotational center line thereof, which is passed through up and down. That is, the first crank connecting portion 1100C is supported by a first taper bearing 1100T mounted on the first lower rod 1110 so as to be rotatable about the rotational center line of the first crank connecting portion 1100C.

Referring to FIGS. 19 and 20, like in the first embodiment of the crank device set, a lower end of the first upper rod 1120 is connected to the first crank connecting portion 1100C so that first upper rod 1120 can be rotated about a rotational center line thereof, which is horizontally passed through. That is, the first upper rod 1120 is rotatably connected to the first crank connecting portion 1100C by a first pin 1120P which is horizontally inserted.

Referring to FIGS. 19 and 20, like in the first embodiment of the crank device set, the first linear guide 1130 is fixed to an upper end of the first upper rod 1120 so as to guide a movement in a horizontal direction which is the same as the rotational center line of the first upper rod 1120.

Referring to FIGS. 19 and 20, like in the first embodiment of the crank device set, the first horizontally moving body 1140 is installed at the first linear guide 1130 so as to be guided along the first linear guide 1130 and also to be movable in the horizontal direction which is the same as the rotational center line of the first upper rod 1120.

Referring to FIGS. 19 and 20, like in the first embodiment of the crank device set, one end of the first crank motor mount 1150 is fixed to the first horizontally moving body 1140, and the other end thereof is fixed with a first crank motor 1160.

Referring to FIGS. 19 and 20, like in the first embodiment of the crank device set, the first rotating plate 1170 is connected with a motor shaft 1160C of the first crank motor 1160.

Referring to FIGS. 19 and 20, like in the first embodiment of the crank device set, one end of the first rotating bar 1180 is rotatably connected to the first rotating plate 1170, and the other end thereof is rotatably connected to the first upper rod 1120. And, a first rotating plate protruded shaft 1172 is formed on an outer surface of the first rotating plate 1170, and a 1-1st bearing 1181 is installed at the one end of the first rotating bar 1180 so that the one end of the first rotating bar 1180 can be relatively rotated with respect to the first rotating plate protruded shaft 1172. Further, the first upper rod 1120 is also provided with a first upper rod protruded shaft 1122 which is protruded from the first upper rod 1120 toward the first rotating bar 1180, and a 1-2nd bearing 1182 is installed at the other end of the first rotating bar 1180 so that the other end of the first rotating bar 1180 can be relatively rotated with respect to the first upper rod protruded shaft 1122. Thus, as the motor shaft 1160C of the first crank motor 1160 is rotated when the first crank motor 1160 is operated, the first horizontally moving body 1140 is guided along the first linear guide 1130. Meanwhile, the first upper rod protruded shaft 1122 is disposed to be not located on the same straight line as the motor shaft 1160C of the first crank motor 1160 regardless of any relative position between the first horizontally moving body 1140 and the first linear guide 1130, such that the first horizontally moving body 1140 can be always guided along the first linear guide 1130 when the first crank motor 1160 is operated.

Referring to FIG. 19, like in the first embodiment of the crank device set, the second crank 1200 includes a second lower rod 1210, a second crank connecting portion 1200C and a second upper rod 1220.

Referring to FIG. 1, like in the first embodiment of the crank device set, the lower end of the second lower rod 1210 is connected to the second moving unit U2 of a robot for virtual reality experience so as to be moved left/right and up/down, and the second lower rod 1210 is parallelly spaced apart from the first lower rod 1110 in a desired distance. Further, like in the first embodiment, a second lower rod guiding body 1420 is inserted onto the second lower rod 1210, and a second left/right movement guiding rod 1520 is inserted into the second lower rod guiding body 1420.

Figure 21:
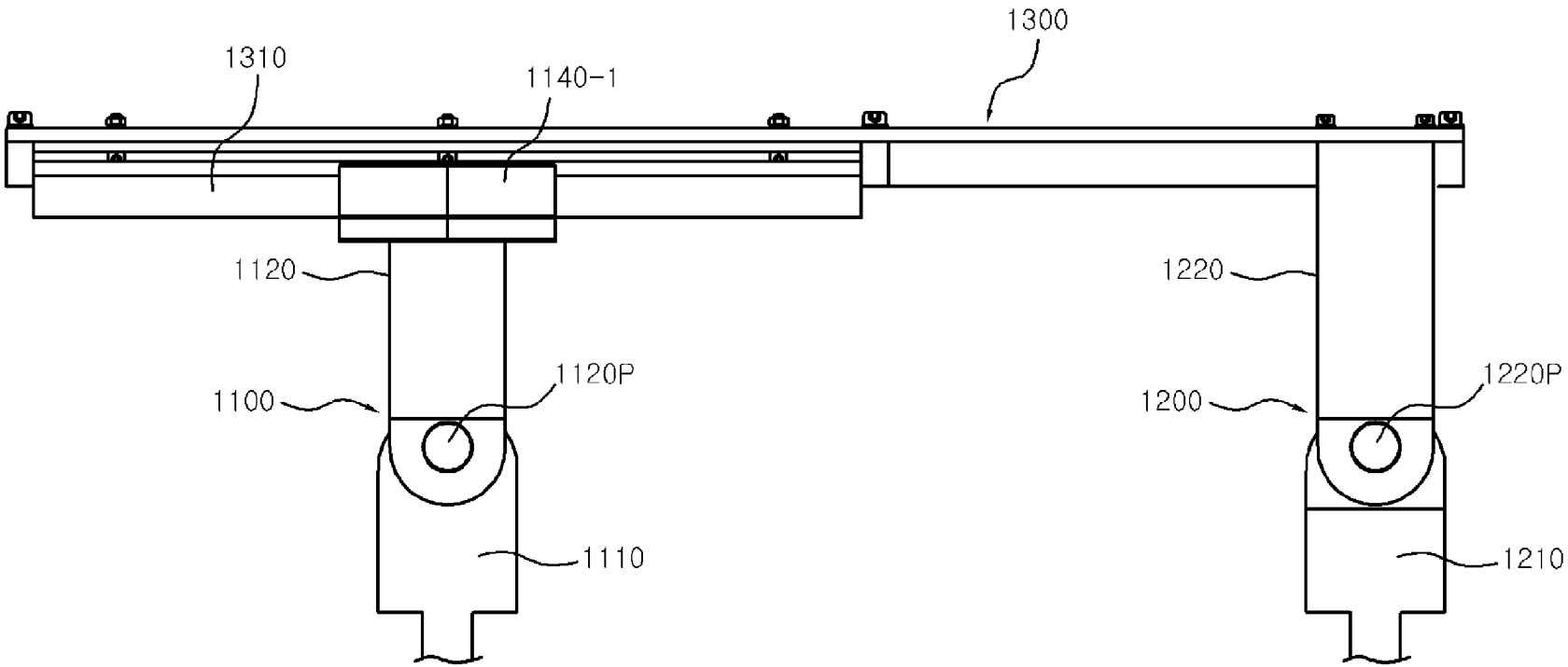
FIG. 21 is a front view of a main part of a third crank device set.

Referring to FIGS. 19 and 21, like in the first embodiment of the crank device set, a lower end of the second crank connecting portion 1200C is connected to the second lower rod 1210 so that the second crank connecting portion 1200C can be rotated about a rotational center line thereof, which is passed through up and down. That is, the second crank connecting portion 1200C is supported by a second taper bearing 1200T mounted on the second lower rod 1210 so as to be rotatable about the rotational center line of the second crank connecting portion 1200C.

Referring to FIGS. 19 and 21, like in the first embodiment of the crank device set, a lower end of the second upper rod 1220 is connected to the second crank connecting portion 1200C so that the second upper rod 1220 can be rotated about a rotational center line thereof, which is horizontally passed through. That is, the second upper rod 1220 is rotatably connected to the second crank connecting portion 1200C by a second pin 1220P which is horizontally inserted.

Referring to FIGS. 19 and 21, a first moving body guiding rod 1310 is formed at one side of the settling body 1300, and the first horizontally moving body 1140 is connected to the first moving body guiding rod 1310 so as to be slidable in a perpendicular direction to a guiding direction of the first linear guide 1130. A tubular slider 1140-1 fixed to the first crank motor mount 1150 is installed at the first moving body guiding rod 1310, and thus the first horizontally moving body 1140 can be slidably coupled to the first moving body guiding rod 1310. Meanwhile, an upper portion of the second upper rod 1220 is fixedly connected to the other side of the settling body 1300.

In other words, unlike in the first embodiment, the crank device set of the second embodiment does not include the second linear guide 1230, the second horizontally moving body 1240, the second crank motor mount 1250, the second rotating plate 1270 and the second rotating bar 1280. Other things that are not described herein are based on the first embodiment.

Third Embodiment of the Crank Device Set

Referring to FIGS. 1 and 21, like in the first embodiment of the crank device set, the crank device set according to the third embodiment includes a first crank 1100, a second crank 1200 and a settling body 1300.

Referring to FIG. 21, the first crank 1100 includes a first lower rod 1110 and a first upper rod 1120. That is, unlike in the first embodiment of the crank device set, the crank device set of the third embodiment does not include the first crank connecting portion 1100C.

Referring to FIG. 1, like in the first embodiment of the crank device set, a lower end of the first lower rod 1110 is connected to the first moving unit U1 so as to be moved left/right and up/down. Further, like in the first embodiment of the crank device set, a first lower rod guiding body 1410 is inserted onto the first lower rod 1110, and a first left/right movement guiding rod 1510 is inserted into the first lower rod guiding body 1410.

Referring to FIG. 21, like in the first embodiment of the crank device set, a lower end of the first upper rod 1120 is connected to the first lower rod 1110 so that first upper rod 1120 can be rotated about a rotational center line thereof, which is horizontally passed through. That is, the first upper rod 1120 is rotatably connected to the first lower rod 1110 by a first pin 1120P which is horizontally inserted.

Referring to FIG. 21, the second crank 1200 includes a second lower rod 1210 and a second upper rod 1220. That is, unlike in the first embodiment of the crank device set, the crank device set of the third embodiment does not include the second crank connecting portion 1200C.

Referring to FIG. 1, like in the first embodiment, the lower end of the second lower rod 1210 is connected to the second moving unit U2 of a robot for virtual reality experience so as to be moved left/right and up/down, and the second lower rod 1210 is parallelly spaced apart from the first lower rod 1110 in a desired distance. Further, like in the first embodiment, a second lower rod guiding body 1420 is inserted onto the second lower rod 1210, and a second left/right movement guiding rod 1520 is inserted into the second lower rod guiding body 1420.

Referring to FIG. 21, a lower end of the second upper rod 1220 is connected to the second lower rod so that the second upper rod 1220 can be rotated about a rotational center line thereof, which is horizontally passed through. That is, the second upper rod 1220 is rotatably connected to the second lower rod 1210 by a second pin 1220P which is horizontally inserted.

Referring to FIG. 21, a first moving body guiding rod 1310 is formed at one side of the settling body 1300, and an upper end of the first lower rod 1120 is connected to the first moving body guiding rod 1310 so as to be slidable left and right. A tubular slider 1140-1 fixed to the first crank motor mount 1150 is installed at the first moving body guiding rod 1310, and thus the first lower rod 1120 can be slidably coupled to the first moving body guiding rod 1310. Meanwhile, an upper portion of the second upper rod 1220 is fixedly connected to the other side of the settling body 1300.

In other words, unlike in the first embodiment of the crank device set, the crank device set of the third embodiment does not include the first linear guide 1130, the first horizontally moving body 1140, the first crank motor mount 1150, the first rotating plate 1170, the first rotating bar 1180, the second linear guide 1230, the second horizontally moving body 1240, the second crank motor mount 1250, the second rotating plate 1270 and the second rotating bar 1280.

Fourth Embodiment of the Crank Device Set

Figure 22:
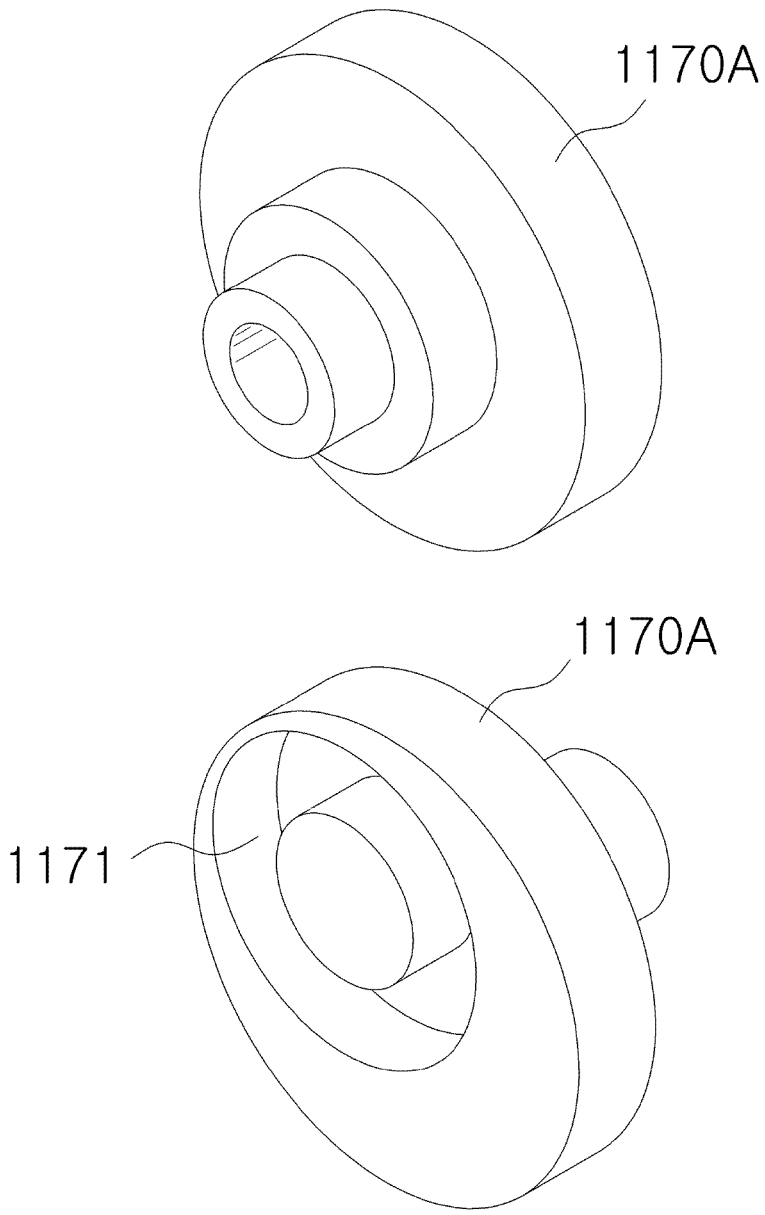
FIG. 22 is a perspective view of a third rotating plate.

Referring to FIGS. 1 and 15, the first or second horizontally moving body 1140 or 1240 is horizontally moved according to the rotation of the first or second crank motor 1160 or 1260, and finally, the settling body 1300 is moved front and back (in an x-axial direction). In the fourth embodiment of the crank device set, as shown in FIG. 22, a third rotating plate 1170A may be used as a medium for transmitting the rotational movement of the first or second crank motor 1160 or 1260 to the first or second horizontally moving body 1140 or 1240.

That is, as described above, the rotational force of the first crank motor 1160 is transmitted to the motor shaft 1160C of the first crank motor 1160, the first rotating plate 1170, the first rotating bar 1180 and the like and then transmitted to the first upper rod protruded shaft 1122. In the fourth embodiment of the crank device set, the first rotating plate 1170 and the first rotating bar 1180 may be replaced with the third rotating plate 1170 shown in FIG. 22.

The motor shaft 1160C of the first crank motor 1160 or the motor shaft 1260C of the second crank motor 1260 is inserted into one side of the third plate 1170, and the first upper rod protruded shaft 1122 or the second upper rod protruded shaft 1222 is inserted into the other side thereof. The third rotating plate 1170 is formed with an eccentric groove 1171 which is eccentric from a center of the third rotating plate 1170, and the first upper rod protruded shaft 1122 or the second upper rod protruded shaft 1222 is inserted into the eccentric groove 1171.

Accordingly, the rotational force of the first crank motor 1160 is transmitted to the motor shaft 1160C of the first crank motor 1160, and thus third rotating plate 1170 is rotated. However, since the third rotating plate 1170 is formed with the eccentric groove 1171, the first upper rod protruded shaft 1122 can be moved front and back (in the x-axial direction). Other construction elements are based on the above-mentioned description.

INDUSTRIAL APPLICABILITY

A movement of almost every object, such as a person, a horse, a board, a ski and a car, under gravitation is a series of waveforms with different lengths and amplitudes due to various changes in speed. In order to make a more realistic robot for virtual reality experience, in which a person can ride, with reference to the movement, the present invention allows to independently control a speed, length and amplitude of the waveform and also to form different types of waveforms by continuously controlling the speed, length and amplitude of the waveform in real time.

The robot for virtual reality experience of the present invention is a very important core technology which forms the foundation of a virtual reality experience part of the virtual reality technology. The present invention can be combined with various contents and thus used in arcade game, medical treatment, education and almost all industrial fields.

While the present invention has been described with respect to the specific embodiments, it will be apparent to those skilled in the art that various changes and modifications may be made without departing from the spirit and scope of the invention as defined in the following claims.

The invention claimed is:

1. A robot for virtual reality experience that generates various 3D-waveforms of the non-fixed curved trajectory, comprising:

a settling body 1300 on which a user can ride; and one or more moving units U1, U2 which are disposed at a lower side of the settling body 1300 so as to move the settling body 1300 up/down or left/right, the moving unit units U1, U2 comprising:

a rotation supporting body 100, 150;

a main rotating body 300, 350 which is installed at the rotation supporting body 100, 150 so as to be rotatable by external driving force and in which a main through-hole 341, 371 is formed in a length direction, and a first main installing protrusion 361, 391 and a second main installing protrusion 362, 392 protruded in a length direction are formed at one side thereof so as to be opposed to each other with the main through-hole 341, 371 in the center;

a guide shaft 810, 850 of which one end is installed at the first main installing protrusion 361, 391 and the other end is installed at the second main installing protrusion 362, 392 and that a screw thread is formed on an outer circumferential surface thereof;

a moving body 820, 870 which are coupled with the guide shaft 810, 850; and a control module M which rotates the guide shaft 810, 850 so that the moving body 820, 870 is moved in a length direction of the guide shaft 810, 850.

2. The robot for virtual reality experience according to claim 1, wherein the control module M comprises:

a first sub rotating body 410 which is axially formed with a first sub through-hole 411-1 and provided with a first sub rotating shaft 411 rotatably inserted into the main through-hole 341 and a first sub gear 412 formed at an outer circumferential surface of one end of the first sub rotating shaft 411 and located at an outer side of the main rotating body 300;

a second sub rotating body 420 which is provided with a second sub rotating shaft 421 rotatably inserted into the first sub through-hole 411-1 and a second sub gear 422 formed at an outer circumferential surface of one end of the second sub rotating shaft 421 so as to be located at an outer side of the first sub gear 412;

a first rotation stopper 510 which functions to stop rotation of the first sub rotating body 410 by external force;

a second rotation stopper 520 which functions to stop rotation of the second sub rotating body 420 by external force;

a 1-1st operation gear 611 which is rotatably installed at one end of the main rotating body 300 and engaged with the first sub gear 412;

a 1-1st bevel gear 711 which is integrally formed at an outer surface of the 1-1st operation gear 611;

a 1-2nd operation gear 612 which is rotatably installed at an inner surface of the first main installing protrusion 361;

a 1-2nd bevel gear 712 which is integrally formed at an outer surface of the 1-2nd operation gear 612 and engaged with the 1-1st bevel gear 711;

a 1-3rd operation gear 613 which is rotatably installed at an inner surface of the first main installing protrusion 361 and engaged with the 1-2nd operation gear 612;

a 2-1st operation gear 621 which is rotatably installed at one end of the main rotating body 300 so as to be opposed to the 1-1st operation gear 611 and which is engaged with the second sub gear 422;

a 2-1st bevel gear 721 which is integrally formed at an outer surface of the 2-1st operation gear 621;

a 2-2nd operation gear 622 which is rotatably installed at an inner surface of the second main installing protrusion 362;

a 2-2nd bevel gear 722 which is integrally formed at an outer surface of the 2-2nd operation gear 622 and engaged with the 2-1st bevel gear 721; and a 2-3rd operation gear 623 is rotatably installed at an inner surface of the second main installing protrusion 362 and engaged with the 2-2nd operation gear 622, and wherein one end of the guide shaft 810 is integrally connected to an outer surface of the 1-3rd operation gear 613 so as to be integrally rotated together with the 1-3rd operation gear 613 and the 2-3rd operation gear 623, and the other end thereof is integrally connected to an outer surface of the 2-3rd operation gear 623.

3. The robot for virtual reality experience according to claim 2, further comprising:

a first sub coupling plate 413 which is integrally coupled to the other end of the first sub rotating shaft 411 so as to be located at an outer side of the other end of the main rotating body 300 and which is formed with a through-hole for first sub coupling plate through which a second sub rotating shaft 421 is rotatably passed;

a second sub coupling plate 423 which is integrally coupled to the other end of the second sub rotating shaft 421 so as to be located at an outer side of an outer side of the first sub coupling plate 413; and a stopping supporter 530 which is disposed between the first and second sub coupling plates 413 and 423 and through which the second sub rotating shaft 421 is rotatably passed, and wherein the first rotation stopper 510 is a first rotation stopping plate which is attached to one surface of the stopping supporter 530 so as to be capable of being coupled to the first sub coupling plate 413 by electromagnetic force generated from an electromagnet installed therein, and the second rotation stopper 520 is a second rotation stopping plate which is attached to the other surface of the stopping supporter 530 so as to be capable of being coupled to the second sub coupling plate 423 by electromagnetic force generated from an electromagnet installed therein.

4. The robot for virtual reality experience according to claim 2, wherein the main rotating body 300 comprises:

a worm wheel 310 that a worm wheel inserting hole is formed in a center portion thereof;

an insertion shaft 340 which is inserted into the worm wheel inserting hole and integrally coupled to the worm wheel 310 and which is formed with the main through-hole 341; and a rotating plate 360M which is integrally coupled to the outer circumferential surface of the one end of the insertion shaft 340 and on which the first and second main installing protrusion 361 and 362 are protruded, and wherein a worm 210 which rotates the worm wheel by external driving force is installed at the rotation supporting body 100.

5. The robot for virtual reality experience according to claim 1, wherein the control module M comprises:

a sub rotating body 450 which is provide with a sub rotating shaft 460 rotatably inserted into the main through-hole 371, a sub gear 451 disposed at an outer circumferential surface of one end of the sub rotating shaft 460 and located at an outer side of the main rotating body 350, and a first control gear 452 formed at an outer surface of the other end of the sub rotating shaft 460 and located at an outer side of one end of the rotation supporting body 150;

a second control gear 552 which is engaged with the first control gear 452;

a control motor 550 which rotates the second control gear 552;

an operation gear 650 which is rotatably installed at one end of the main rotating body 300 and engaged with the sub gear 451;

a first bevel gear 750 which is integrally formed at an outer surface of the operation gear 650; and a second bevel gear 751 which is rotatably installed at an inner surface of one of the first and second main installing protrusions 391 and 392 and engaged with the first bevel gear 750, and wherein one end of the guide shaft 850 is connected to the second bevel gear 751 so that the guide shaft 850 can be integrally rotated with the second bevel gear 751.

6. The robot for virtual reality experience according to claim 1, wherein the main rotating body 350 comprises:

a worm wheel 360;

an insertion shaft 370 in which the worm wheel 360 is inserted; and a rotating plate 390M which is coupled to the outer circumferential surface of the one end of the insertion shaft 370 and on which the first main installing protrusion 391 and the second main installing protrusion 392 are protruded, and wherein a worm 250 which rotates the worm wheel 360 by external driving force is installed at the rotation supporting body 150.

7. The robot for virtual reality experience according to claim 1, further comprising:

a first crank 1100 comprising a first lower rod 1110 of which a lower end is connected to the first moving unit U1 of the robot for virtual reality experience so as to be moved left/right and up/down, a first crank connecting portion 1100C of which a lower end is connected to the first lower rod 1110 so that the first crank connecting portion 1100C can be rotated about a rotational center line thereof, which is passed through up and down, and a first upper rod 1120 of which a lower end is connected to the first crank connecting portion 1100C so that the first upper rod 1120 can be rotated about a rotational center line thereof, which is horizontally passed through;

a second crank 1200 comprising a second lower rod 1210 of which a lower end is connected to the second moving unit U2 of the robot for virtual reality experience so as to be moved left/right and up/down, a second crank connecting portion 1200C of which a lower end is connected to the second lower rod 1210 so that the second crank connecting portion 1200C can be rotated about a rotational center line thereof, which is passed through up and down, and a second upper rod 1220 of which a lower end is connected to the second crank connecting portion 1200C so that the second upper rod 1220 can be rotated about a rotational center line thereof, which is horizontally passed through;

a first linear guide 1130 which is installed at the first upper rod 1120 so as to guide a movement in a horizontal direction which is the same as the rotational center line of the first upper rod 1120;

a first horizontally moving body 1140 which is installed at the first linear guide 1130 so as to be guided along the first linear guide 1130 by driving force of a first crank motor 1160;

a second linear guide 1230 which is installed at the second upper rod 1220 so as to guide a movement in a horizontal direction which is the same as the rotational center line of the second upper rod 1220; and a second horizontally moving body 1240 which is installed at the second linear guide 1230 so as to be guided along the second linear guide 1230 by driving force of a second crank motor 1260, and wherein a first moving body guiding rod 1310 to which the first horizontally moving body 1140 is connected so as to be slidable in a perpendicular direction to a guiding direction of the first linear guide 1130 is formed at one side of the settling body 1300, and the second horizontally moving body 1240 is fixedly connected to the other side of the settling body 1300.

8. The robot for virtual reality experience according to claim 7, further comprising:

a first crank motor mount 1150 of which one end is fixed to the first horizontally moving body 1140, and the other end thereof is fixed with the first crank motor 1160;

a first rotating plate 1170 which is connected to the first crank motor 1160;

a first rotating bar 1180 of which one end is rotatably connected to the first rotating plate 1170 and the other end is rotatably connected to the first upper rod 1120, such that the first horizontally moving body 1140 is guided along the first linear guide 1130 when the first crank motor 1160 is operated;

a second crank motor mount 1250 of which one end is fixed to the second horizontally moving body 1240 and the other end is fixed to the second crank motor 1260;

a second rotating plate 1270 which is rotatably connected to the second crank motor 1260; and a second rotating bar 1280 of which one end is rotatably connected to the second rotating plate 1270 and the other end is rotatably connected to the second upper rod 1220, such that the second horizontally moving body 1240 is guided along the second linear guide 1230 when the second crank motor 1260 is operated.

9. The robot for virtual reality experience according to claim 8, further comprising:

a first rotating plate protruded shaft 1172 which is formed on a first rotating plate 1170;

a 1-1st bearing 1181 which is installed at one end of the first rotating bar 1180 so that the one end of the first rotating bar 1180 can be relatively rotated with respect to the first protruded shaft 1172 of the first rotating plate 1170;

a first upper rod protruded shaft 1122 which is formed on the first upper rod 1120;

a 1-2nd bearing 1182 which is installed at the other end of the first rotating bar 1180 so that the other end of the first rotating bar 1180 can be relatively rotated with respect to the first upper rod protruded shaft 1122;

a second rotating plate protruded shaft 1272 which is formed on a second rotating plate 1270;

a 2-1st bearing 1281 which is installed at one end of the second rotating bar 1280 so that the one end of the second rotating bar 1280 can be relatively rotated with respect to the second rotating plate protruded shaft 1272;

a second upper rod protruded shaft 1222 which is formed on the second upper rod 1220; and a 2-2st bearing 1282 which is installed at the other end of the second rotating bar 1280 so that the other end of the second rotating bar 1280 can be relatively rotated with respect to the second upper rod protruded shaft 1222.

10. The robot for virtual reality experience according to claim 7, further comprising:

a first lower rod guiding body 1410 which is inserted onto the first lower rod 1110 so as to guide an up and down movement of the first lower rod 1110;

a first left/right movement guiding rod 1510 which is inserted into the first lower rod guiding body 1410 so as to guide a left and right movement of the first lower rod guiding body 1410;

a second lower rod guiding body 1420 which is inserted onto the second lower rod 1210 so as to guide an up and down movement of the second lower rod 1210; and a second left/right movement guiding rod 1520 which is inserted into the second lower rod guiding body 1420 so as to guide a left and right movement of the second lower rod guiding body 1420.

11. The robot for virtual reality experience according to claim 7, wherein the first crank connecting portion 1100C is supported by a first taper bearing 1100T mounted on the first lower rod 1110 and disposed to be rotatable about the rotational center line of the first crank connecting portion 1100C, and the second crank connecting portion 1200C is supported by a second taper bearing 1200T mounted on the second lower rod 1210 and disposed to be rotatable about the rotational center line of the second crank connecting portion 1200C.

* * * * *